US012747406B2

(12) United States Patent
Haidasz et al.

(10) Patent No.: US 12,747,406 B2
(45) Date of Patent: Sep. 29, 2026

(54) FUSED-RING POLYCYCLIC AMINE FUNCTIONALIZED OLEFINIC POLYMERS FOR LUBRICATING OIL COMPOSITIONS

(71) Applicant: INFINEUM INTERNATIONAL LIMITED, Abingdon (GB)

(72) Inventors: Evan Haidasz, Hoboken, NJ (US); John Keily, Oxford (GB); Mark P. Driver, Didcot (GB)

(73) Assignee: Infineum International Limited, Linden, NJ (US)

( * ) Notice: Subject to any disclaimer, the term of this patent is extended or adjusted under 35 U.S.C. 154(b) by 0 days.

(21) Appl. No.: 18/950,358

(22) Filed: Nov. 18, 2024

(65) Prior Publication Data

US 2025/0188379 A1 Jun. 12, 2025

Related U.S. Application Data

(60) Provisional application No. 63/607,786, filed on Dec. 8, 2023.

(51) Int. Cl.
*C10M 107/42* (2006.01)
*C10M 129/20* (2006.01)

(52) U.S. Cl.
CPC ..... *C10M 107/42* (2013.01); *C10M 129/20* (2013.01); *C10M 2217/003* (2013.01)

(58) Field of Classification Search
CPC ..... C10M 107/42; C10M 129/20; C10M 2217/003
See application file for complete search history.

(56) References Cited

U.S. PATENT DOCUMENTS

| | | | |
|---|---|---|---|
| 4,141,847 | A | 2/1979 | Kiovsky |
| 4,160,739 | A | 7/1979 | Stambaugh et al. |
| 4,367,074 | A | 1/1983 | Maldonado et al. |
| 4,670,173 | A | 6/1987 | Hayashi et al. |
| 4,693,838 | A | 9/1987 | Varma et al. |
| 4,734,213 | A | 3/1988 | Brewster et al. |
| 4,900,461 | A | 2/1990 | Ver Strate et al. |
| 4,941,984 | A | 7/1990 | Chamberlin, III et al. |
| 5,049,294 | A | 9/1991 | Van Zon et al. |
| 5,073,600 | A | 12/1991 | Gorman et al. |
| 5,147,570 | A | 9/1992 | Van Zon et al. |

(Continued)

FOREIGN PATENT DOCUMENTS

| | | |
|---|---|---|
| EP | 0515152 A1 | 11/1992 |
| EP | 0882782 A2 | 9/1998 |

(Continued)

OTHER PUBLICATIONS

International Search Report and Written Opinion for related PCT Application No. PCT/IB2024/000674 dated Mar. 27, 2025.

*Primary Examiner* — Ishal V Vasisth
(74) *Attorney, Agent, or Firm* — Robert A. Migliorini

(57) ABSTRACT

This disclosure relates to functionalized olefinic polymers comprising an olefinic polymer bound to at least one fused-ring polycyclic amine for each polymer molecule, wherein the fused-ring polycyclic amine comprises at least one secondary amine and at least one other heteroatom therein and further comprises at least one primary amine directly pendant thereto, wherein the at least one fused-ring polycyclic amine is bound to the olefinic polymer through the at least the one primary amine.

22 Claims, 1 Drawing Sheet

(56) References Cited

U.S. PATENT DOCUMENTS

| | | | | |
|---|---|---|---|---|
| 5,162,086 | A * | 11/1992 | Migdal | C10M 151/02 525/331.7 |
| 5,264,139 | A | 11/1993 | Mishra et al. | |
| 5,264,140 | A | 11/1993 | Mishra et al. | |
| 5,275,746 | A | 1/1994 | Kapuscinski et al. | |
| 5,429,758 | A | 7/1995 | Hayashi et al. | |
| 5,512,192 | A | 4/1996 | Lange et al. | |
| 5,540,851 | A | 7/1996 | Lange | |
| 5,633,415 | A | 5/1997 | Brandes et al. | |
| 5,651,927 | A | 7/1997 | Auda et al. | |
| 5,780,540 | A | 7/1998 | Brandes et al. | |
| 5,811,378 | A | 9/1998 | Lange | |
| 5,942,471 | A | 8/1999 | Kapuscinski et al. | |
| 6,034,184 | A | 3/2000 | Coolbaugh et al. | |
| 6,054,539 | A | 4/2000 | Coolbaugh et al. | |
| 6,103,676 | A | 8/2000 | Coolbaugh et al. | |
| 6,107,258 | A | 8/2000 | Esche, Jr. et al. | |
| 6,162,768 | A | 12/2000 | Coolbaugh et al. | |
| 6,215,033 | B1 | 4/2001 | Coolbaugh et al. | |
| 6,228,817 | B1 | 5/2001 | Coolbaugh et al. | |
| 6,248,702 | B1 | 6/2001 | Coolbaugh et al. | |
| 6,319,881 | B1 | 11/2001 | Coolbaugh et al. | |
| 6,486,101 | B2 | 11/2002 | Luciani et al. | |
| 6,492,306 | B2 | 12/2002 | Sivik et al. | |
| 6,818,601 | B1 | 11/2004 | Lange | |
| 7,960,320 | B2 | 6/2011 | Covitch et al. | |
| 7,981,847 | B2 | 7/2011 | Goldblatt et al. | |
| 8,354,362 | B2 | 1/2013 | Price et al. | |
| 8,557,753 | B2 | 10/2013 | Gieselman et al. | |
| 8,637,437 | B2 | 1/2014 | Gieselman et al. | |
| 8,912,133 | B2 | 12/2014 | Gieselman et al. | |
| 8,969,266 | B2 | 3/2015 | Crawley et al. | |
| 9,115,237 | B2 | 8/2015 | McDougall et al. | |
| 9,234,153 | B2 | 1/2016 | McDougall et al. | |
| 9,644,167 | B2 | 5/2017 | Gieselman et al. | |
| 10,005,979 | B2 | 6/2018 | Saccomando et al. | |
| 10,190,070 | B2 | 1/2019 | Goldblatt et al. | |
| 10,421,923 | B2 | 9/2019 | Saccomando et al. | |
| 10,424,999 | B2 | 9/2019 | Carabell et al. | |
| 10,731,100 | B2 | 8/2020 | Taribagil et al. | |
| 2014/0066345 | A1* | 3/2014 | Gieselman | C10M 143/04 508/293 |
| 2018/0044610 | A1 | 2/2018 | Mayhew et al. | |
| 2021/0087493 | A1 | 3/2021 | Mayhew et al. | |

FOREIGN PATENT DOCUMENTS

| | | | |
|---|---|---|---|
| GB | 1548464 | A | 7/1979 |
| GB | 1568951 | A | 6/1980 |
| WO | 97/32946 | A1 | 9/1997 |
| WO | 99/25744 | A1 | 5/1999 |
| WO | 2006/088693 | A3 | 8/2006 |
| WO | 2021/127183 | A1 | 6/2021 |

* cited by examiner

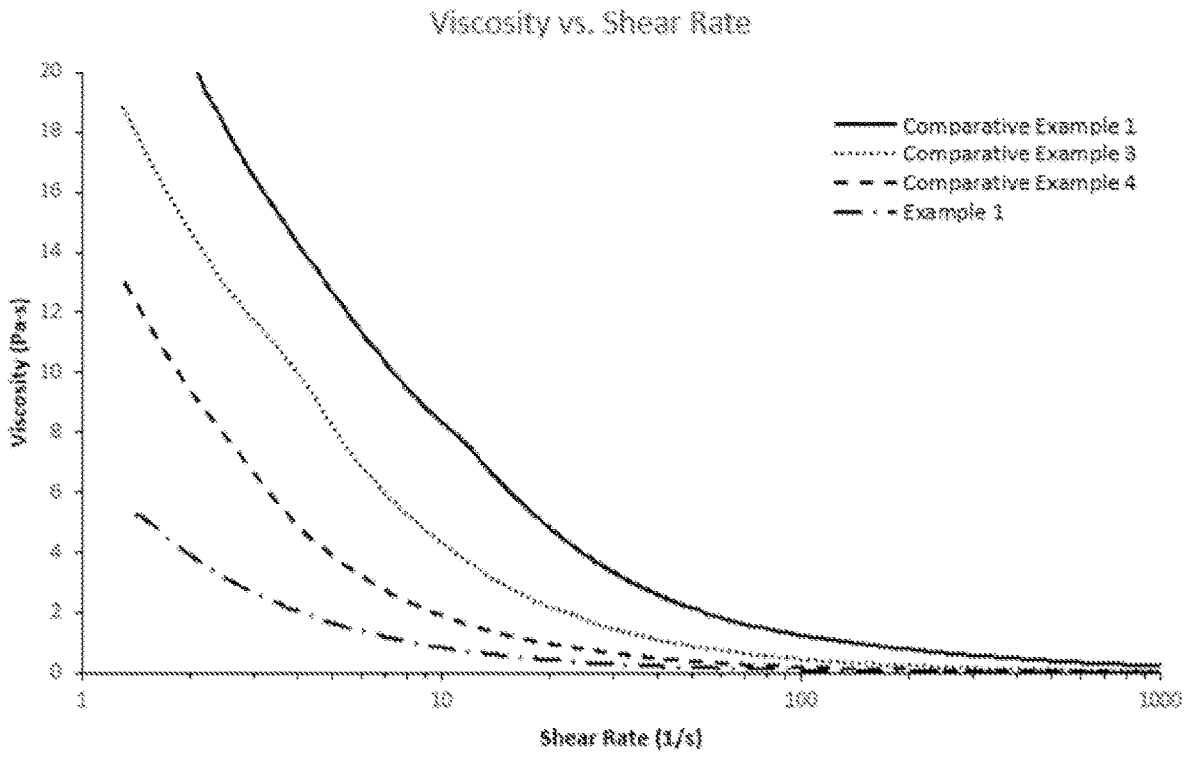
Viscosity vs. Shear Rate
Viscosity (Pa·s)
Shear Rate (1/s)
0
2
4
6
8
10
12
14
16
18
20
1
10
100
1000
Comparative Example 1
Comparative Example 3
Comparative Example 4
Example 1

FUSED-RING POLYCYCLIC AMINE FUNCTIONALIZED OLEFINIC POLYMERS FOR LUBRICATING OIL COMPOSITIONS

CROSS-REFERENCE TO RELATED APPLICATION

This U.S. Non-provisional application claims priority to U.S. Provisional Application Ser. No. 63/607,786 filed on Dec. 8, 2023, the contents of which are herein incorporated by reference in their entirety.

FIELD OF THE INVENTION

This disclosure relates to the use of fused-ring polycyclic amine functionalized olefinic polymers, olefinic polymers such as functionalized polyolefinic and conjugated diene polymers, that are useful as additives in lubricating oil compositions and having good dispersancy in engine crankcase applications, especially in compression ignited engine applications.

BACKGROUND OF THE INVENTION

The emphasis on fuel economy has been increased in recent years. One approach to improve the fuel economy of vehicles is to design new lubricant oils that reduce friction while maintaining a good film thickness for durability and wear protection while also preventing soot-induced viscosity increase. To improve fuel economy, the use and stipulation of low viscosity grades by Original Equipment Manufacturers (OEM) is becoming increasingly widespread. One of the challenges for the provision of engine and/or drive train transmission oils having these reduced viscosity grades is maintaining cleanliness. Such oils must be able to reduce sludge, provide good soot handling, and provide wear protection, whilst providing desired fuel economy benefits. These targets should be achieved while maintaining low levels of sulphated ash and phosphorus, as well as ensuring seal compatibility. There is a need to provide new engine oils having low viscosity grades that meet these requirements.

Base stocks are typically modified by the addition of additives such as viscosity index improvers (VIIs) and/or dispersants. VIIs may be used to reduce the extent to which the viscosity of lubricants changes with temperature and are often used to formulate engine and transmission lubricants. Common VIIs typically include polymeric materials that may be derived from ethylene-propylene copolymers, polymethacrylates, hydrogenated styrene-butadiene copolymers, polyisobutylenes, etc.

During engine operation, oil-insoluble oxidation byproducts, such as soot, are produced. Dispersants help keep these byproducts suspended or in solution, thus diminishing their deposition on metal surfaces. This is referred to as "soot dispersancy" or simply "dispersancy". Common dispersants include (poly)alkenylsuccinic derivatives such as hydrocarbyl-substituted succinic anhydrides, polyisobutylene succinic anhydride (PIBSA), hydrocarbyl-substituted succinimides such as polyisobutylene succinimides (PIBSA-PAM), and those derived from the reaction of maleated polyisobutylene with 4-aminodiphenylamine (or N-phenyl-p-phenylenediamine, ADPA). Useful dispersants also include polyisobutenes including functional groups such as succinimides, hydroxyethyl imides, succinate esters/amides, and oxazolines.

Other dispersants are derived from the reaction of maleated polyalphaolefins (such as ethylene-propylene copolymers) and polyamine. Maleic anhydride is reacted or grafted onto an ethylene-propylene copolymer backbone in the presence of a solvent and then the grafted copolymer is reacted with a polyamine such as an N-arylphenylene diamine in the presence of a surfactant to provide a multifunctional olefin copolymer viscosity index improver.

Still other dispersants are derived from styrenic copolymers. U.S. Pat. No. 6,248,702 discloses maleated selectively hydrogenated styrenic block copolymer reacted with aminopropyl morpholine to form a dispersant substance. Still other dispersants are derived from copolymers of two different conjugated dienes, such as block copolymers of isoprene and butadiene. U.S. Pat. No. 5,780,540 discloses functionalized selectively hydrogenated isoprene butadiene di-block copolymers in automotive additive packages. Similarly, U.S. Pat. No. 6,319,881 discloses functionalized selectively hydrogenated isoprene butadiene di-block copolymers in automotive additive packages.

It has been found that fused-ring polycyclic amine functionalized polymers are promising candidates as oil additives with good dispersancy. "Fused-ring polycyclic amines" are hydrocarbon structures having at least three "fused" (bound through at least two shared carbon atoms) aromatic or aliphatic rings and comprising at least one secondary amine therein, thus excluding structures such as N-phenyl-p-phenylenediamine where two aromatic rings are bound through only one shared carbon atom each. For instance, U.S. Pat. No. 5,162,086 is directed to additive compositions comprising graft and amine-derivatized copolymers comprising an amine substituted phenothiazine, wherein the phenothiazine is a fused-ring polycyclic amine comprising two or more pendant amines and/or alkylamines thereto.

Also, U.S. Pat. No. 5,275,746 is directed to viscosity index improvers containing EPM or EPDM polymers modified with phenothiazines having an alkylamine group pendant thereto. Also, U.S. Pat. No. 5,942,471 is directed to viscosity index improvers comprising hydrocarbon polymers modified with phenothiazine having an alkylamine group pendant thereto.

There remains a need to provide lubricant fluids having improved dispersancy and viscosity properties. The inventors provide such improvement as described herein using a functionalized olefinic polymer comprising olefinic polymers functionalized with polycyclic aromatic amines having at least one primary amine directly pendant thereto, where the at least one fused-ring polycyclic amine is bound to the olefinic polymer through the at least the one primary amine.

SUMMARY OF THE INVENTION

This disclosure relates to functionalized olefinic polymers comprising (or consisting of, or consisting essentially of) an olefinic polymer bound to at least one fused-ring polycyclic amine, wherein the fused-ring polycyclic amine comprises (or consists of, or consists essentially of) at least one secondary amine and at least one other heteroatom therein and further comprises (or consists of, or consists essentially of) at least one primary amine directly pendant thereto, wherein the at least one fused-ring polycyclic amine is bound to the olefinic polymer through the at least the one primary amine.

In any embodiment pendant amine groups comprising an alkyl-linking group or chain between the primary amine and fused-ring polycyclic amine are absent.

In any embodiment the fused-ring polycyclic amine comprises a secondary amine bridging group joining at least two aromatic rings and at least one other heteroatom within the ring structure.

In any embodiment the fused-ring polycyclic amine comprises aromatic rings selected from the group consisting of benzene, naphthalene, anthracene, phenanthrene, pyrene, and combinations thereof, and phenyl- and alkyl-substituted versions thereof.

In any embodiment the fused-ring polycyclic amine is a tricyclic aromatic amine comprising two aromatic rings bridged by a nitrogen atom as a first bridge, and a second bridge comprising a heteroatom radical selected from the group consisting of —O—, —NH—, —Se—, —S—, —SO—, and —$SO_2$—.

In any embodiment, the fused-ring polycyclic amine is selected from the group consisting of 3-aminophenothiazine, 3-amino-10H-phenoxazine, 3-aminophenoxathiine, 3-aminophenothiazine-5-oxide, 3-aminophenothiazine-5,5-dioxide, 3,7-diamino-10H-phenothiazine, and combinations thereof.

Also disclosed is a lubricating oil composition ("LOC") comprising or resulting from the admixing of at least 50 mass % of one or more base stocks, based upon the weight of the LOC; and one or more functionalized olefinic polymers as described herein.

These and other embodiments of the invention will be described in more detail herein.

BRIEF DESCRIPTION OF THE DRAWINGS

FIG. 1 is a graph of liquid viscosity as a function of shear rate for an inventive fused-ring polycyclic amine functionalized olefinic polymer and three comparative examples.

DEFINITIONS

For purposes of this specification and all claims to this invention, the following words and expressions, if and when used, have the meanings ascribed below.

For purposes herein, the new numbering scheme for the Periodic Table of the Elements is used as set out in Chemical and Engineering News, 63 (5), 27 (1985), i.e., Alkali metals are Group 1 metals (e.g., Li, Na, K, etc.) and Alkaline earth metals are Group 2 metals (e.g., Mg, Ca, Ba, etc.).

The term "lubricating oil composition", or "LOC", refers to a blend of the functionalized olefinic polymer as described herein with at least one base stock, and optionally, other additives that are known in the oil additives art such as described herein.

The term "major amount" means more than 50 mass % of a composition, such as more than 60 mass % of a composition, such as more than 70 mass % of a composition, such as from 80 to 99.009 mass % of a composition, such as from 80 to 99.9 from 80 to 99.009 mass % of a composition, of a composition based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "mass %" means mass percent of a component, based upon the mass of the composition as measured in grams, unless otherwise indicated, and is referred to as weight percent ("weight %", "wt %", or "% w/w").

The terms "oil-soluble" and "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The term "group" as it relates to substitutions of a hydrogen atom on a hydrocarbyl refers to radical moieties that are bound through a chemical bond to the hydrocarbyl.

The term "hydrocarbon" means a compound of hydrogen and carbon atoms. A "heteroatom" is an atom other than carbon or hydrogen. When referred to as "hydrocarbons", particularly as "refined hydrocarbons", the hydrocarbons may also contain one or more heteroatoms or heteroatom-containing groups (such as halo, especially chloro and fluoro, amino, alkoxyl, mercapto, alkylmercapto, nitro, nitroso, sulfoxy, etc.) in specified amounts, preferably in an amount of less than 1 wt % of the hydrocarbon. A "hydrocarbyl" is a hydrocarbon radical, that is, it is deficient in one or more hydrogen and/or carbon atoms such that it is a group chemically bound to another compound or group. In any embodiment, the group consists essentially of, such as consists only of, hydrogen and carbon atoms, unless specified otherwise. In an embodiment the hydrocarbyl group comprises an aliphatic hydrocarbyl group. The term "hydrocarbyl" includes "alkyl", "alkenyl", "alkynyl", and "aryl" as defined herein. Hydrocarbyl groups may contain one or more atoms/groups other than carbon and hydrogen provided they do not affect the essentially hydrocarbyl nature of the hydrocarbyl group.

The term "alkyl" means a monovalent group of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e., unbranched) or branched, be cyclic, acyclic, or part cyclic/acyclic. In an embodiment the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl.

The term "alkenyl" means a monovalent group of carbon and hydrogen (such as a $C_2$ to $C_{30}$ group, such as a $C_2$ to $C_{12}$ group) having at least one double bond. Alkenyl groups in a compound are typically bonded to the compound directly via a carbon atom. Unless otherwise specified, alkenyl groups may be linear (i.e., unbranched) or branched, be cyclic, acyclic or part cyclic/acyclic.

The term "alkylene" means a $C_1$ to $C_{20}$, such as a $C_1$ to $C_{10}$, bivalent saturated aliphatic group, which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene, and 1-ethyl propylene.

An "olefin", alternatively referred to as "alkene", is a linear, branched, or cyclic compound of carbon and hydrogen having at least one double bond. For purposes of this specification and the claims appended thereto, when a polymer or copolymer is referred to as comprising an olefin ("olefinic"), the olefin present in such polymer or copolymer is the polymerized form of the olefin. For example, when a copolymer is said to have an "isoprene" content of 55 wt % to 95 wt %, it is understood that the mer unit in the copolymer is derived from isoprene in the polymerization reaction and said derived units are present at 55 wt % to 95 wt %, based upon the weight of the copolymer. A "polymer" has two or more of the same or different mer units. A "homopolymer" is a polymer having mer units that are the same. A "copolymer" is a polymer having two or more mer units that are different from each other. "Different" as used to refer to mer units indicates that the mer units differ from each other by at least one atom or are different isomerically. An "isoprene polymer" or "isoprene copolymer" is a polymer or copolymer comprising at least 50 mol % isoprene derived units, a "butadiene polymer" or "butadiene copolymer" is a polymer or copolymer comprising at least 50 mol % butadiene derived units, and so on. Likewise, when a polymer is referred to as a "partially or fully saturated polymer comprising $C_{4-5}$ olefins", the $C_{4-5}$ olefin(s) present in such polymer or copolymer are the polymerized form of the olefin(s), and the polymer has been partially or fully saturated (such as by hydrogenation) after polymerization of the monomers.

The term "alkynyl" means a monovalent $C_2$ to $C_{30}$ (such as a $C_2$ to $C_{12}$) group, which includes at least one carbon-to-carbon triple bond.

The term "aryl" means a group containing at least one aromatic ring, such a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom-containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with hydrocarbon group, a heteroatom, or a heteroatom-containing group. An alkyl substituted derivative means a hydrogen atom has been replaced with an alkyl group. An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and/or triacontyl.

The term "halogen" or "halo" means a Group 17 atom or a group of Group 17 atom such as chlorine.

The term "effective amount" in respect of an additive means an amount of such an additive in a LOC so that the additive provides the desired technical effect.

The term "ppm" means parts per million by mass, based on the total mass of the composition or LOC, unless otherwise indicated.

The term "metal content" of a LOC or of an additive component, for example, magnesium content, molybdenum content or total metal content (i.e., the sum of all individual metal contents), is measured by ASTM D5185.

The term "absent" as it relates to components included within the lubricating oil composition s described herein and the claims thereto means that the particular component is present at 0 wt %, based upon the weight of the LOC, or if present in the LOC the component is present at levels that do not impact the LOC properties, such as less than 10 ppm, or less than 1 ppm or less than 0.001 ppm. When the term "absent" is used in relation to monomer reactants and/or to repeat units in (co) polymers described herein, it means present at 0 wt %, based upon the weight of all (co) monomers in the (co) polymer, or, if present at all, at levels so low that they do not substantially impact the physical properties of the (co) polymer, such as at 0.2 wt % or less or at 0.1 wt % or less.

As used herein, Mn is number average molecular weight, Mw is weight average molecular weight, and Mz is z-average molecular weight. Molecular weight distribution (MWD), also referred to as polydispersity index (PDI), is defined to be Mw divided by Mn. Unless otherwise noted, all molecular weight units (e.g., Mw, Mn, Mz) are reported in g/mol.

Total Base Number also referred to as "TBN", in relation to an additive component or of a LOC (i.e., unused LOC) means total base number as measured by ASTM D2896 and reported in units of mgKOH/g.

Phosphorus, Boron, Calcium, Zinc, Molybdenum, Sodium, Silicon, and Magnesium content are measured by ASTM D5185.

Sulfur content in oil formulations is measured by ASTM D5185.

Sulfated ash ("SASH") content is measured by ASTM D874.

Kinematic viscosity (KV100, KV40) is determined pursuant to ASTM D445-19a and reported in units of cSt, unless otherwise specified.

Viscosity index is determined according to ASTM D2270.

Saponification number (SAP) is determined by ASTM D94, and reported in units of mgKOH/g.

Average functionality, also referred to as Average Functionality Value (Fv) is determined by Gel Permeation Chromatography using polystyrene standards as described in the Experimental section below.

Unless otherwise indicated, all percentages reported are mass % on an active ingredient basis, i.e., without regard to carrier or diluent oil, unless otherwise indicated.

Also, it will be understood that various components used, essential as well as optimal and customary, may react under conditions of formulation, storage or use and that the disclosure also provides the product obtainable or obtained as a result of any such reaction.

Further, it is understood that any upper and lower quantity, range and ratio limits set forth herein may be independently combined.

Also, it will be understood that the preferred features of each aspect of the present disclosure are regarded as preferred features of every other aspect of the present disclosure. Accordingly, preferred and more preferred features of one aspect of the present disclosure may be independently combined with other preferred and/or more preferred features of the same aspect or different aspects of the present disclosure.

DETAILED DESCRIPTION OF THE INVENTION

The present invention herein relates to olefinic polymers that have been grafted or otherwise functionalized with fused-ring polycyclic amines as described herein, preferably accomplished in a multistep functionalization process with acylating agents (carboxylic-acid anhydrides) and then further derivatized with fused-ring polycyclic amine such as phenothiazine and its derivatives as exemplified by the compound 3-aminophenothiazine (or "PTZ") (1):

(1)

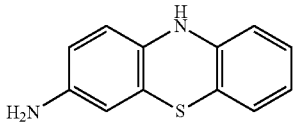

PTZ

Desirably, such functionalized olefinic polymers exhibit advantages such as: (a) Exceptional carbon black/soot dispersancy versus polymers functionalized with other amine functional groups (e.g. ethylenediamine oligomers (polyamine, PAM) or N-phenyl-p-phenylenediamine (ADPA)); and (b) Improved antioxidant performance/oxidation resistance versus polymers containing other amine functional groups. These attributes enable improved dispersancy performance in fully LOCs, or consistent performance levels at a reduced dispersant treat rate, thereby reducing costs and enabling oil formulations at reduced viscometrics. The inventive functionalized olefinic polymers can be used as components either within or outside of additive packages and/or FFOs to provide improved soot or carbon dispersancy performance. More effective dispersants allow lower treat rates compared conventional dispersants.

Thus, disclosed herein is a functionalized olefinic polymer comprising an olefinic polymer bound to at least one fused-ring polycyclic amine, wherein the fused-ring polycyclic amine comprises at least one secondary amine and at least one other heteroatom therein and further comprises at least one primary amine directly pendant thereto, wherein the at least one fused-ring polycyclic amine is bound to the olefinic polymer through the at least the one primary amine. In any embodiment, pendant amine groups comprising an alkyl-linking group or chain between the primary amine and fused-ring polycyclic amine are absent. Stated another way, the fused-ring polycyclic amine comprises at least one primary amine directly pendant to the ring system such as in the structure (1) above and there are no alkyl amine groups bound to the fused-ring polycyclic amine such as, for example, $H_2N—CH_2$-(1), or $H_2N—R_n$-(1), wherein n is an integer 1, 2, 3, 4 or greater, and "R" is a divalent hydrocarbon group.

In a more particular embodiment, the functionalized olefinic polymer comprises a fused-ring polycyclic amine comprising a secondary amine bridging group joining at least two aromatic rings and at least one other heteroatom within the ring structure. In any embodiment, the fused-ring polycyclic amine comprises aromatic rings selected from the group consisting of benzene, naphthalene, anthracene, phenanthrene, pyrene, and combinations thereof, and phenyl- and alkyl-substituted versions thereof. In any embodiment, the fused-ring polycyclic amine is a tricyclic aromatic amine comprising two aromatic rings bridged by a nitrogen atom as a first bridge, and a second bridge comprising a heteroatom radical selected from the group consisting of —O—, —NH—, —Se—, —S—, —SO—, and —$SO_2$—. Specific examples of fused-ring polycyclic amines include but are not limited to those selected from the group consisting of 3-aminophenothiazine, 3-amino-10H-phenoxazine, 3-aminophenoxathiine, 3-aminophenothiazine-5-oxide, 3-aminophenothiazine-5,5-dioxide, 3,7-diamino-10H-phenothiazine, and combinations thereof.

In any embodiment, more than one type of fused-ring polycyclic amine can be used to form the functionalized olefinic polymers described herein. For example, a polymer may be functionalized with 3-aminophenothiazine and 3-aminophenothiazine-5,5-dioxide in any desirable mole ratio. Also, in any embodiment the olefinic polymer may be additionally functionalized with ethyleneamines and/or oligomers of ethyleneamines within a range from 0.1, or 0.5, or 1 mol % up to 30, or 40, or 50, or 60, or 70, or 80 mol % of the functional groups on the olefinic polymer, where at least a portion of the remaining functional groups are the fused-ring polycyclic amines. "Ethyleneamines" are polyethylene polyamines, a mixture of tetraethylenepentamine (TEPA), pentaethylenehexamine (PEHA), hexaethyleneheptamine (HEHA), and higher molecular weight products. E-100 is a complex mixture of various linear, cyclic, and branched products with a number-average molecular weight of 250-300 g/mole.

In any embodiment, the fused-ring polycyclic amine can be described with reference to the structure (2):

(2)

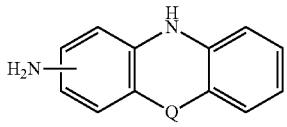

wherein Q is a heteroatom radical selected from the group consisting of —O—, —NH—, —Se—, —S—, —SO—, and —$SO_2$—. Preferably, pendant amine groups comprising an alkyl-linking group or chain between the primary amine and fused-ring polycyclic amine are absent from structure (2). Also, at least one fused-ring polycyclic amine is bound to the olefinic polymer through the pendant primary amine. The primary amine may be bound to the 1, 2, 3, or 4 position, but is preferably bound to the 3 position. In any embodiment, there are within a range from 1, 2, 3, to 4, 6, 8, or 10, or 12 fused-ring polycyclic amines bound to each olefinic polymer molecule.

In any embodiment, the olefinic polymer useful in the functionalized olefinic polymer is any olefinic polymer such as polymers or copolymers of any one or combination of a C2, or C3, or C4 olefin to C10, or C12, or C14 olefin or diolefin, and can be primary, secondary, or tertiary olefins. Preferably the olefinic polymer is selected from the group consisting of polyisobutylene; ethylene-propylene copolymer; hydrogenated polyisoprene polymer; and polybutadiene polymer; and copolymers thereof, and hydrogenated versions thereof.

In more particular embodiments, the polymer useful herein to prepare the functionalized olefinic polymer may be a homopolymer or copolymer of one or more of ethylene, propylene, butene, 1-pentene, 2,3-dimethyl-butadiene, 2-methyl-1,3-pentadiene, myrcene, 3-methyl-1,3-pentadiene, 4-methyl-1,3-pentadiene, 2-phenyl-1,3-butadiene, 2-phenyl-1,3-pentadiene, 3-phenyl-1,3 pentadiene, 2,3-dimethyl-1,3-pentadiene, 2-hexyl-1,3-butadiene, 3-methyl-1,3-hexadiene, 2-benzyl-1,3-butadiene, 1,3-butadiene, 1,3-pentadiene, 1,3-hexadiene, 1,3-heptadiene, 2,4-heptadiene, 1,3-octadiene, 2,4-octadiene, 3,5-octadiene, 1,3-nonadiene, 2,4-nonadiene, 3,5-nonadiene, 1,3-decadiene, 2,4-decadiene, and 3,5-decadiene, (optionally the comonomer(s) are present at less than 20 mol %, or less than 5 mol %, or less than 3 mol %, or less than 1 mol %, or less than 0.1 mol %).

The functionalized olefinic polymer and/or the polymer useful to prepare the functionalized olefinic polymer may be homopolymer or copolymer. The copolymer may be a random copolymer, a tapered block copolymer, a star copolymer, or a block copolymer. Block copolymers are formed from a monomer mixture comprising one or more first monomers (such as isobutylene), wherein, for example, a first monomer forms a discrete block of the polymer joined to a second discrete block of the polymer formed from a second monomer (such as butadiene). While block copolymers have substantially discrete blocks formed from the monomers, a tapered block copolymer may be composed of, at one end, a relatively pure first monomer and, at the other end, a relatively pure second monomer. The middle of the tapered block copolymer may be more of a gradient composition of the two monomers.

Polymers useful herein to prepare the functionalized olefinic polymers may have an Mn within a range from 500 to 100,000 g/mole, such as from 600 to 60,000 g/mole, or such as from 800 to 40,000 g/mole, or such as from 1000 to 5000 g/mole, or such as from 600 to 5000 g/mole, or such as from 600 to 2000 g/mole (GPC-PS).

Polymers useful herein to prepare the functionalized olefinic polymers may have an Mw/Mn (GPC-PS) within a range from 1 to 2, or 2.5, or 3, or 3.5, or 4. In any embodiment, the polymers useful herein to prepare the functionalized olefinic polymers may have an Mw/Mn of 1 or more to less than 4 (such as less than 3.5, such as less than 3, such as less than 2.5).

The polymers used to prepare the functionalized olefinic polymers may have an Mz (as determined by GPC-PS) of from 20,000 to 150,000 g/mol, such as from 25,000 to 140,000 g/mol, such as from 30,000 to 125,000 g/mol, such as from 35,000 to 100,000 g/mol, such as from 40,000 to 80,000 g/mol, such as from 40,000 to 60,000 g/mol (GPC-PS).

Polymers useful herein to prepare the functionalized olefinic polymers may have a glass transition temperature (Tg) of −25° C. or less, such as −40° C. or less, such as −50° C. or less, as determined by Differential Scanning calorimetry (DSC) using a Perkin Elmer or TA Instrument Thermal Analysis System (sample is heated from ambient to 210° C. at 10° C./minute and held at 210° C. for 5 minutes, then cooled down to −40° C. at 10° C./minute and held for 5 minutes).

Polymers useful herein to prepare the functionalized olefinic polymers typically have a residual unsaturation of less than 3%, such less than 2%, such less than 1%, such as less than 0.5%, such as less than 0.25% based upon number of double bonds in the non-hydrogenated polymer.

In any embodiment, if desirable or necessary the polymer is partially or fully hydrogenated prior to functionalization.

Polymers useful herein to prepare the functionalized olefinic polymers typically have a residual metal (such as Li, Co, and Al) content of less than 100 ppm, such less than 50 ppm, such as less than 25 ppm, such as less than 10 ppm, such as less than 5 ppm.

In any embodiment, The functionalized olefinic polymers described herein have an Mn within a range from 500, or 600, or 800, or 1000 g/mole to 4000, or 5000, or 40,000, or 60,000, or 100,000 g/mol (as determined by GPC-PS).

In any embodiment the functionalized olefinic polymers have an Mw/Mn (GPC-PS) within a range from 1 to 2, or 2.5, or 3, or 3.5, or 4. In any embodiment, the functionalized olefinic polymers have an Mw/Mn of 1 or more to less than 4 (such as less than 3.5, such as less than 3, such as less than 2.5).

In any embodiment, The functionalized olefinic polymers described herein have an Mz (as determined by GPC-PS) of from 2,000 to 150,000 g/mol, such as from 2,500 to 140,000 g/mol, such as from 3,000 to 125,000 g/mol, such as from 3,500 to 100,000 g/mol, such as from 4,000 to 80,000 g/mol, such as from 4,000 to 60,000 g/mol (GPC-PS).

In any embodiment, The functionalized olefinic polymer described herein possess a Functionality Value (Fv), representing the average number of succinic anhydride groups (or other first stage polymer precursor) and/or fused-ring polycyclic amines per polymer chain, of 12, or 10, or 8, or 6, or 4, or 3 or less. That is, the Fv value may take into account that while the first stage acylation (or other) process may have caused acylation of the polymer, most but not all of those sites were replaced by the fused-ring polycyclic amines. In any embodiment, the final product comprises greater than 90, or 95, or 98% fused-ring polycyclic amine functional groups compared to the first stage acylation of the olefinic polymer.

In any embodiment, the functionalized olefinic polymer is obtained by reacting fully or partially hydrogenated polymer with an acylating agent and thereafter reacting the acylated polymer with the fused-ring polycyclic amine to form the functionalized olefinic polymer. In any embodiment, the wherein the acylating agent is succinic anhydride. This is described further below.

In any embodiment, the functionalized olefinic polymer may have a Saponification Number (SAP) of 25 (such as 28, such as 30, such as 32, such as 34) mgKOH/g or more, as determined by ASTM D94.

In any embodiment, the functionalized olefinic polymer may contribute 17% or more (such as 20% or more, such as from 17 to 40%, such as from 20 to 30%) to the Saponification Number of the LOC.

As stated previously, the unique attributes of the inventive functionalized olefinic polymer described herein enable improved dispersancy performance in fully formulated oils, or consistent performance levels at a reduced dispersant treat rate, thereby reducing costs and enabling oil formulations at reduced viscometrics. Such advantages can be quantified for instance in its measured viscosity in the presence of carbon black. As measured in the description below, in any embodiment the functionalized olefinic polymers have a viscosity at a shear rate of 2.1 $s^{-1}$ (±0.1) of less than 12, or 10, or 8 Pa-s, indicative of good dispersancy.

Process to Produce Functionalized Olefinic Polymers

In any embodiment, the functionalized olefinic polymers comprising one or more fused-ring polycyclic amines may be obtained by any means of polymer grafting or functionalization known in the art. Desirably, the functionalized olefinic polymers are obtained in a two-step process whereby a first step comprises a first activation step to, for example, acylate the unsaturated groups of the starting olefinic polymer, followed by treating this product with the one or more desired fused-ring polycyclic amines. In a particular embodiment the functionalized olefinic polymer may be obtained by reacting the olefinic polymer with an acylating agent to form acylated polymer and then reacting acylated polymer with a fused-ring polycyclic amines. The functionalized olefinic polymer may also be obtained by reacting an acylated olefinic polymer (such as a commercially available maleated fully or partially hydrogenated olefinic polymer) with fused-ring polycyclic amines.

In any embodiment, the acylation/functionalization reactions described herein may take place in the presence of a base stock diluent. As a side product, functionalized base stock can be produced. The oil may become acylated and/or functionalized itself. For example, maleated base stock or aminated base stock may be present after the functionalization reactions described herein.

The fully or partially saturated (hydrogenated) olefinic polymer may be chemically modified (functionalized) to provide a polymer having at least one polar functional group, such as, but not limited to, halogen, epoxy, hydroxy, amino, nitrilo, mercapto, imido, carboxy, and sulfonic acid groups of combinations thereof. The polar-functionalized olefinic polymers can be further modified to give a more desired type of functionality such as the fused-ring polycyclic amine. In a preferred case, the fully or partially hydrogenated polymer is functionalized by a method comprising reacting the fully or partially hydrogenated polymer with an unsaturated carboxylic acid (or derivative thereof, such as maleic anhydride) to provide an acylated polymer (which may then be further functionalized as described below).

In some embodiments, a carboxylic acid functionality or a reactive equivalent thereof is grafted onto the polymer to form an acylated polymer. An ethylenically unsaturated carboxylic acid material is typically grafted onto the polymer backbone. These materials which are attached to the polymer typically contain at least one ethylenic bond (prior to reaction) and at least one, such as two, carboxylic acid (or its anhydride) groups or a polar group which is convertible into said carboxyl groups by oxidation or hydrolysis. Maleic anhydride or a derivative thereof is suitable in a preferred embodiment. It grafts onto the polymer to give two carboxylic acid functionalities. Examples of additional unsaturated carboxylic materials include itaconic anhydride, or the corresponding dicarboxylic acids, such as maleic acid, fumaric acid and their esters, as well as cinnamic acid and esters thereof.

The ethylenically unsaturated carboxylic acid material may be grafted onto the polymer in a number of ways and the invention is not limited as such. It may be grafted onto the polymer in solution or in essentially pure (molten) form with or without using a radical initiator. Free-radical induced grafting of ethylenically unsaturated carboxylic acid materials may also be conducted in solvents, such as hexane or mineral oil. It may be carried out at an elevated temperature in the range of from 100° C. to 250° C., such as from 120° C. to 190° C., or from 150° C. to 180° C.; e.g., above 160° C.

The free-radical initiators which may be used include peroxides, hydroperoxides, and azo compounds, typically those which have a boiling point greater than 100° C. and which decompose thermally within the grafting temperature range to provide free radicals. Representative of these free-radical initiators include azo-bis-iso-butyronitrile and 2,5-dimethyl-hex-3-yne-2,5-bis-tertiary-butyl peroxide. The initiator may be used in an amount of 0.005% to 1% by weight based on the weight of the reaction mixture solution. The grafting may be carried out in an inert atmosphere, such as under nitrogen blanketing. The resulting acylated polymer intermediate is characterized by having carboxylic acid acylating functions as a part of its structure.

In any embodiment, the acylated polymer may have a Saponification Number (SAP) of 5 g/KOH or more, such as 10 g/KOH or more, such as 20 g/KOH or more, such as 30 g/KOH or more, such as 50 g/KOH or more, such as from 10 to 60 g/KOH, such as from 20 to 40 g/KOH as determined by ASTM D94.

In any embodiment, the acylated polymer composition may have less than 5 wt % unreacted acylating agent (such as maleic anhydride), such as less than 4 wt %, such as less than 3 wt %, such as less than 1 wt %, such as less than 0.5 wt %, such as less than 0.25 wt %, such as less than 0.1 wt %, based upon the weight of the acylated polymer composition (i.e., polymer, acylating agent, and diluent).

In any embodiment, the acylation reactions described herein may take place in base stock diluent. As a side product, functionalized base stock can be produced. The oil may become acylated itself. For example, maleated base stock may be present after the acylation reactions described herein.

It is contemplated that the functionalized base stock may comprise the acylated oil and/or the reaction product of the acylated oil with an amine to form an amide, imide or combination thereof.

In an embodiment one or more functionalized base stocks, such as acylated oil and/or reaction product of the acylated oil with an amine or alcohol to form an amide, imide, ester, or combination thereof, may be present in the LOC (or concentrate) at an amount of from 0.01 to 40 mass %, such as from 0.1 to 20 mass %, such as from 1 to 10 mass %, such as from 1.5 to 5 mass %, (such as at 3 mass % or less, such as 2 mass % or less, such as 1 mass % or less, such as at 0.1 mass % or less, such as at 0 mass %), based upon the weight of the LOC.

In any embodiment, the acylation reactions described herein take place in solvent containing media. As a side product, acylated/functionalized solvent can be produced. In any embodiment, acylated and/or functionalized solvent may be present in a concentrate composition at 3 mass % or less, such as 2 mass % or less, such as 1 mass % or less, such as at 0.1 mass % or less, such as at 0 mass %, based upon the weight of the concentrate composition. In any embodiment, functionalized solvent may be present in a LOC at 3 mass % or less, such as 2 mass % or less, such as 1 mass % or less, such as at 0.1 mass % or less, such as at 0 mass %, based upon the weight of the LOC.

The reaction may be run to minimize side reactions where the acylating agent (such as maleic acid or maleic anhydride) is added in a continuous or semi-continuous (such as intermittent) stream (In any embodiment, for example, in controlled relatively equal portions over the reaction time, or larger and/or smaller portions at different points in the reaction) to minimize functionalized base stock and other side reactions. As an example, the acylating agent may be added in a continuous fashion where the amounts of polymer and acylating agents are added in controlled stoichiometric amounts. As another example, the polymer may be added to a reaction vessel in batch fashion and the acylating agent added slowly or in a semi-continuous fashion (such as adding the acylating agent in 2 or more, such as 5 or more, such as 10 or more, such as 20 or more, such as 30 or more, such as 40 or more, such as 50 or more, such as 60 or more discrete amounts or portions). In any embodiment, the polymer can be added to the reaction vessel in X number of portions and the acylating agent added in 1.5× or more (such as 2× or more, such as 5× or more, such as 10× or more, such as 20× or more, such as 30× or more, such as 40× or more, such as 50× or more, such as 60× or more) number of portions. This same effect may also be achieved by diluting or concentrating a polymer solution and/or the acylating agent solution to the same or different extents.

Also, the reaction may be run to minimize side reactions by using different concentrations of the polymer in diluent, such as 45 wt % or more, or 50 wt % or more, or 55 wt % or more, or 60 wt % or more in batch, semi-continuous, or continuous reactor operations. For example, the polymer (such as a hydrogenated isoprene polymer, such as hydrogenated homo-polyisoprene) may be introduced into batch, semi-continuous, or continuous reactor operations as solution or suspension (such as a slurry) in diluent (such as oil (e.g., base stock, such as a Group I, II, III, IV, and/or V base stock, such as a Group II and/or Group III base stock) or alkane solvent or diluent or a combination thereof), where the polymer may be present in the solution or suspension at 45 wt % or more (or 50 wt % or more, or 55 wt % or more, or 60 wt % or more), based upon the weight of the polymer and diluent.

In any embodiment, side reactions are minimized, optionally by adding the acylating agent in a continuous or semi-continuous fashion, and/or by introducing the fully or partially hydrogenated polymer (such as isoprene polymer) into batch, semi-continuous, or continuous reactor operations as solution or suspension in diluent, said solution or suspension comprising 45 wt % or more (or 50 wt % or more, or 55 wt % or more, or 60 wt % or more), of the fully or partially hydrogenated polymer, based upon the weight of the fully or partially hydrogenated polymer and diluent.

In any embodiment, the acylated olefinic polymer may be reacted with one or more fused-ring polycyclic amines. The reaction may consist of condensation to form an imide, an amide, a half-amide, amide-ester, diester, or an amine salt. A primary amino group will typically condense to form an amide or, in the case of maleic anhydride, an imide. In any embodiment, the amine may have a single primary amino group or multiple primary amino groups.

In any embodiment, the functionalization (such as amination) reactions described herein may take place in diluent (such as base stock or alkane solvent). As a side product, functionalized diluent (such as functionalized base stock) can be produced. It is contemplated that the functionalized diluent (such as functionalized base stock) may comprise reaction product of the acylated diluent (such as acylated base stock) with an amine to form an amide, imide or combination thereof.

In an embodiment the reaction product of the acylated diluent (such as acylated oil) with the fused-ring polycyclic amines may be present in a concentrate in an amount of 40 wt % or less, such as 20 wt % or less, such as 10 wt % or less, such as 5 wt % or less, such as 3 mass % or less, such as 2 mass % or less, such as 1 mass % or less, such as at 0.1 mass % or less, such as at 0 mass % (such as 0 to 40 mass %, such as 0.01 to 40 mass %, such as 0.1 to 20 mass %, such as to 1 to 10 mass %, such as 1.5 to 5 mass %), based upon the weight of the concentrate composition.

In an embodiment one or more functionalized base stocks, such as the reaction product of the acylated diluent (such as acylated base stock) with the fused-ring polycyclic amines may be present in the LOC at an amount of 0.01 to 40 mass %, such as 0.1 to 20 mass %, such as to 1 to 10 mass %, such as 1.5 to 5 mass %, (such as at 3 mass % or less, such as 2 mass % or less, such as 1 mass % or less, such as at 0.1 mass % or less, such as at 0 mass %), based upon the weight of the LOC.

In any embodiment, the functionalization (such as amination) reactions described herein may take place in solvent-containing media. As a side product, functionalized solvent can be produced. In any embodiment, the functionalized solvent may be present in a concentrate composition at 3 mass % or less, such as 2 mass % or less, such as 1 mass % or less, such as at 0.1 mass % or less, such as at 0 mass %, based upon the weight of the concentrate composition. In any embodiment, functionalized solvent may be present in a LOC at 3 mass % or less, such as 2 mass % or less, such as 1 mass % or less, such as at 0.1 mass % or less, such as at 0 mass %, based upon the weight of the LOC.

In any embodiment, the acylated base stock/solvent may be removed prior to functionalization.

In any embodiment, the functionalized olefinic polymer is not prepared in aromatic solvent (such as benzene or toluene), or aromatic solvent is present at 2 wt % or less (such as 1 wt % or less, such as 0.5 wt % or less), based upon the weight of solvent and polymer.

In any embodiment, the functionalized olefinic polymer is not prepared in an alkylated naphthenic solvent, or alkylated naphthenic solvent is present at 5 wt % or less (such as 3 wt % or less, such as 1 wt % or less), based upon the weight of solvent and polymer.

The polymer useful herein to prepare the functionalized olefinic polymer may be a homopolymer of butadiene, isoprene, or the like. In a particular embodiment the polymer useful herein to prepare the functionalized olefinic polymer may be a homopolymer of isoprene, or a copolymer of isoprene and less than 5 mol % (such as less than 3 mol %, such as less than 1 mol %, such as less than 0.1 mol %) comonomer.

Lubricating Oil Compositions

The LOCs disclosed herein comprise components that may or may not remain the same chemically before and after mixing with a liquid carrier (such as a base stock) and/or other additives. This disclosure encompasses compositions which comprise the components before mixing, or after mixing, or both before and after mixing.

In any embodiment, described herein is a lubricating oil composition or "LOC" comprising or resulting from the admixing of at least 50 mass % of one or more base stocks, based upon the weight of the LOC, with at least one or more functionalized olefinic polymers as described herein. In any embodiment, the LOC further comprises one or more additional additives selected from the group consisting of dispersants; detergents; friction modifiers; antioxidants; pour point depressants; anti-foam agents; viscosity modifiers; inhibitors and/or anti-rust agents; and antiwear agents.

More preferably the LOC described herein result from the admixing of:

(a) from at least 50 to 99.9 mass % (such as 55 to 99.85 mass %, such as 60 to 99.8 mass %, such as 70 to 99.75 mass %, such as 75 to 99.5 mass %) of one or more base stocks, based upon the weight of the lubricating composition;

(b) from 0.10 to 50 mass % (such as from 0.15 to 45 mass %, such as 0.20 mass % to 40 mass %, such as 0.25 to 30 mass %, such as 0.5 to 25 mass %), based upon the weight of the composition, of one or more functionalized olefinic polymers as described herein, and optionally one or more other additives.

In any embodiment the LOC may exhibit:

1) an SAE viscosity grade of 20W-X, 15W-X, 10W-X, 5W-X, or 0W-X (such as 15W-X, 10W-X, 5W-X), where X represents any one of 8, 12, 16, 20, 30, 40, and 50 (such as 30 and 40); and 2) a valve train rocker arm wear of 150 mg or less, such as 100 mg or less, such as 80 mg or less (as determined by Ford 6.7 L Power Stroke Diesel Engine Test for soot induced wear and viscosity control); and 3) a soot induced camshaft wear of 55 mm or less, such as 50 mm or less, such as 40 mm or less (as determined by Cummins ISB Diesel Engine Test for valve train wear control); and 4) a soot dispersancy of 5% soot or more, such as 6% soot or more, such as 6.5% soot or more (as determined by Mack T11 Test for Soot-Induced Viscosity Control ASTM D7156-19, measured at 12 cSt viscosity increase).

In any embodiment, the LOC comprising the functionalized olefinic polymers may further comprise any number of additives such as one or more or a combination of:

A) from 0.10 to 20 mass % (such as from 0.15 to 10 mass %, such as 0.20 mass % to 5 mass %, such as 0.25 to 2 mass %), based upon the weight of the LOC, of one or more detergents (such as blends of detergents);

B) optionally, from 0.01 to 5 wt % (such as from 0.1 to 4 mass %, such as 0.25 to 3 mass %, such as 0.045-0.15 mass %), based on total weight of the LOC, of one or more friction modifiers (such as blends of friction modifiers);

C) optionally, from 0.01 to 10 wt % (such as from 0.01 to 5 wt %, such as 0.01 to 3 mass %, such as 0.1 to 1.5 mass %), based on total weight of the LOC, of one or more antioxidants (such as blends of antioxidants);

D) optionally, from 0.01 to 5 wt % (such as from 0.01 to 3 mass %, such as 0.1 to 1.5 mass %), based on total weight of the LOC, of one or more pour point depressants (such as blends of pour point depressants);

E) optionally, from 0.001 to 5 wt % (such as from 0.01 to 3 mass %, such as 0.1 to 1.5 mass %), based on total weight of the LOC, of one or more anti-foam agents (such as blends of anti-foam agents);

F) optionally, from 0.001 to 10 wt % (such as from 0.01 to 6 wt %, such as 0.01 to 5 mass %, such as 0.1 to 4 mass %, such as 0.1 to 2 mass %, such as 0.1 to 1 mass %), based on total weight of the LOC, of one or more viscosity modifiers (such as blends of viscosity modifiers);

G) optionally, from 0.01 to 20 wt % (such as from 0.1 to 12 mass %, such as 0.1 to 8 mass %), based on total weight of the LOC, of one or more dispersants (such as blends of dispersants);

H) optionally, from 0.01 to 5 wt % (such as from 0.1 to 3 mass %, such as 0.1 to 1.5 mass %), based on total weight of the LOC, of one or more inhibitors and/or anti-rust agents (such as blends of inhibitors and/or anti-rust agents);

I) optionally, from 0.001 to 10 wt % (such as from 0.01 to 5 wt %, such as 0.1 to 3 mass %, such as 0. to 1.5 mass %), based on total weight of the LOC, of one or more antiwear agents (such as blends of antiwear agents, such as ZDDP);

J) optionally, from 0.01 to 5 wt % (such as from 0.05 to 2 mass %, such as 0.1 to 1 mass %), based on total weight of the LOC, of one or more seal compatibility agents, such as seal swell agents; and/or K) optionally, from 0.01 to 5 wt % (such as from 0.1 to 3 mass %, such as 0.1 to 1.5 mass %), based on total weight of the LOC, of one or more unsaturated $C_{12}$-$C_{60}$ hydrocarbons (such as $C_{12}$-$C_{24}$ linear alpha-olefins (LAOs), oligomers/polymers of polyisobutylenes, and/or blends thereof).

The LOC herein may be in the form of a "concentrate", also referred to as an "additive package" (or "addpack").

For purposes of this disclosure, the functionalized olefinic polymers are not added in the elements A through K above for determining weight percentages, even though they may show similar properties. Thus, for example the functionalized olefinic polymers may impact wear positively, yet is not added into element I) for determining weight percent of antiwear agents. Specifically, compositions according to the present disclosure may contain an additive having a different enumerated function that are also functionalized (for example, the dispersant component functionalized olefinic polymer and others described below in the dispersant section). These additives are not included as functionalized olefinic polymer for purposes of determining the amount of functionalized olefinic polymer in a LOC or concentrate herein.

In any embodiment, all of elements A through K are present in addition to the base stock, detergent, and the one or more functionalized olefinic polymers described herein.

Suitably, the LOC may have a total base number (TBN) of 4 to 15 mgKOH/g, such as 5 to 12 mgKOH/g, such as 7 to 12 mgKOH/g, such as 8 to 11 mgKOH/g, as measured by ASTM D2896.

In any embodiment, the LOC described herein may have a valve train wear (Cummins ISB Engine Test, ASTM D7484-21, mm) that is at least 10 mm less (such as at least 20 mm less, such as at least 30 mm less, such as at least 40% less, such as at least 50% less) than the valve train wear (Cummins ISB Engine Test, ASTM D7484-21, mm) of a comparative LOC having a valve train wear (Cummins ISB Engine Test, ASTM D7484-21, mm) of 65 mm or less (such as 15 to 65 mm, such as 35 to 65 mm), that has the same composition as the inventive LOC except that the one or more inventive functionalized olefinic polymers is replaced at same amount (wt %) by a functionalized olefinic copolymer prepared by maleating a similar olefinic polymer then reacting with a functional group such as amine N-phenyl-p-phenylenediamine to obtain an modified olefinic polymer containing one or more pendant amine groups and having 35 mass % active ingredient.

The LOC of the present disclosure may contain low levels of phosphorus, namely not greater than 1600, such as not greater than 1200, such as not greater than 800, such as 1 to 1600, such as from 50 to 1200, such as from 100 to 800 parts per million (ppm) by mass of phosphorus, expressed as atoms of phosphorus, based on the total mass of the LOC, as measured by ASTM D5185.

The LOC of the present disclosure may contain a ratio of atoms of magnesium to atoms of calcium based on the total mass of the LOC, as measured by ASTM D5185, of at least to 0.5, such as at least 0.6, such as at least 0.65.

In any embodiment, the LOC may contain low levels of sulfur. In an embodiment the lubricating composition contains up to 0.4, such as up to 0.3, such as up to 0.2, such as 0.1 to 0.4 mass % sulfur, based on the total mass of the LOC, as measured by ASTM D5185.

In any embodiment, the LOC may contain low levels of sulfated ash, such as 1.2% or less, such as 1.0 mass % or less, such as 0.9 mass or less %, such as 0.8 mass % or less, such as 0.0001 to 0.5 mass % or less sulfated ash, based on the total mass of the lubricating composition, as measured by ASTM D874-13a (2018).

In any embodiment, the kinematic viscosity at 100° C. ("KV100") of the lubricating composition may range from 2 to 30 cSt, such as 2 to 20 cSt, such as 5 to 15 cSt as determined according to ASTM D 445-19a).

In any embodiment, the kinematic viscosity at 100° C. ("KV100") of the lubricating composition may range from 6 to 17 cSt, such as 9 to 16.3 cSt, such as 9.3 to less than 12.5 cSt, such as 12.5 to less than 16.3 cSt, as determined according to ASTM D 445-19a).

In any embodiment, the total base number of the lubricating composition may range from 1 to 30, such as 5 to 15 mgKOH/g, (as determined according to ASTM D2896).

In any embodiment the lubricating composition of the present disclosure may be a multigrade oil identified by the viscometric descriptor SAE 20W-X, SAE 15W-X, SAE 10W-X, SAE 5W-X or SAE 0W-X, where X represents any one of 8, 12, 16, 20, 30, 40, and 50; the characteristics of the different viscometric grades can be found in the SAE J300 classification. In any embodiment, the lubricating composition may be the form of viscosity grade SAE 15W-X, SAE 10W-X, SAE 5W-X or SAE 0W-X, such as in the form of SAE 15W-X or SAE 10W-X, wherein X represents any one of 8, 12, 16, 20, 30, 40, and 50. In any embodiment, the lubricating composition of the present disclosure may be a multigrade oil identified by the viscometric descriptor SAE 10W-30, 15W-40, 5W-30, 5W-40, 10W-40, 5W-50. (See standard SAE J300 published January 2015 by SAE International, formerly known as Society of Automotive Engineers).

In any embodiment, lubricating composition may have a SAE viscosity grade of 0W-Y, wherein Y may be 12, 16, or 20. In one embodiment, the lubricating composition has an SAE viscosity grade of 0W-12.

In any embodiment, the LOC may comprise less than 75 ppm boron, such as less than 60 ppm boron, such as from 1 to 70 ppm boron. In any embodiment, the LOC may be absent boron.

In any embodiment, the LOC may comprise less than 20 (such as less than 15, such as less than 10, such as less than 5, such as less than 3, such as less than 1) mass %, functionalized (such as aminated) polybutene (such as polyisobutylene), such as PIBSA-PAM. In any embodiment, the LOC may comprise, or may be absent, functionalized (such as aminated) polybutene (such as polyisobutylene), such as PIBSA-PAM.

In any embodiment, the LOC may comprise functionalized olefinic polymers derived from acylated polymers, such as polyisobutylene succinic acid (PIBSA), optionally having an Mn of from 500 to 50,000 g/mol, such as from 600 to 5,000 g/mol, such as from 700 to 3000 g/mol. In any embodiment, the LOC may comprise acylated polymers, such as polyisobutylene succinic acid, having an Mn of from 500 to 1600 g/mol, such as from 700 to 1200 g/mol. In any embodiment, the LOC comprises more than 0.1 (such as from 0.1 to 10, such as from 0.5 to 8) mass %, functionalized (such as aminated) polybutene (such as polyisobutylene), such as PIBSA-PAM.

In any embodiment, the LOC may comprise 20 (such as 15, such as 10, such as 5, such as 3, such as 1) mass % or less block copolymer, such as block, star, random, and/or tapered block copolymer).

In any embodiment, the LOC may be absent block copolymer, such as block, star, random, and/or tapered block copolymer.

In any embodiment, the LOC may comprise 20 (such as 15, such as 10, such as 5, such as 3, such as 1) mass % or less styrenic copolymer, such as block, star, random, and/or tapered styrenic block copolymer).

In any embodiment, the LOC may comprise less than 20 (such as less than 15, such as less than 10, such as less than 5, such as less than 3, such as less than 1) mass % of functionalized diluent, such as functionalized oil.

In any embodiment, the LOC may comprise, may be absent functionalized diluent, such as functionalized oil.

In any embodiment, the LOC may comprise less than 20 (such as less than 15, such as less than 10, such as less than 5, such as less than 3, such as less than 1) mass % of solvent, such as aromatic solvent.

In any embodiment, the LOC may be absent solvent, such as functionalized solvent.

In any embodiment, the LOC may have a total saponification number (SAP) of 25 (such as 28, such as 30, such as 32) mgKOH/g or more, as determined by ASTM 94.

In any embodiment, the LOC may comprise less than 0.5 (such as 0.4, such as less than 0.3, such as less than 0.2, such as less than 0.1, or zero) wt %, based upon the weight of the LOC, of secondary hydrocarbyl amine compounds and tertiary hydrocarbyl amine compounds. In any embodiment, the LOC may be substantially absent, or may comprise no, secondary hydrocarbyl amine compounds and tertiary hydrocarbyl amine compounds.

In any embodiment, the LOC of the present disclosure may be a heavy-duty diesel oil (e.g., for use in an engine for a heavy-duty diesel vehicle, i.e., a heavy-duty diesel vehicle having a gross vehicle weight rating of 10,000 pounds or more).

In any embodiment, the LOC of the present disclosure may be a passenger car motor oil. Also, in any embodiment, the lubricating composition of the present disclosure may be a diesel engine lubricating composition.

Base Stock

The base stock useful herein may be a single oil or a blend of oils, and is typically a large liquid constituent of a lubricating oil composition, also referred to as a base oil or lubricant, into which additives and optional additional oils are blended, for example, to produce a LOC, such as a final LOC, a concentrate, or other lubricating composition.

A base stock may be selected from vegetable, animal, mineral, and synthetic lubricating oils, and mixtures thereof. It may range in viscosity from light distillate mineral oils to heavy lubricating oils, such as those for gas engine oil, mineral lubricating oil, motor vehicle oil, and heavy-duty diesel oil. Generally, the kinematic viscosity at 100° C. ("KV100") of the base stock ranges from 1 to 30, such as 2 to 25 cSt, such as 5 to 20 cSt, as determined according to ASTM D445-19a, or more particularly from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt. Generally, the high temperature high shear (HTHS) viscosity at 150° C. of the base stock ranges from 0.5 to 20 cP such as 1 to 10 cP, such as 2 to 5 cP as determined according to ASTM D4683-20.

Typically, when base stock(s) is used to make a concentrate, it may advantageously be present in a concentrate-forming amount to give a concentrate containing, from 5 wt % to 80 wt %, from 10 wt % to 70 wt %, or from 5 wt % to 50 wt % of active ingredient, based upon the weight of the concentrate.

Common oils useful as base stocks include animal and vegetable oils (e.g., castor and lard oil), liquid petroleum oils, and hydrorefined and/or solvent-treated mineral lubricating oils of the paraffinic, naphthenic, and mixed paraffinic-naphthenic types. Oils derived from coal or shale are also useful base stocks. Base stocks may be manufactured using a variety of different processes including, but not limited to, distillation, solvent refining, hydrogen processing, oligomerization, esterification, and re-refining.

Synthetic lubricating oils useful herein as base stocks include hydrocarbon oils such as homopolymerized and copolymerized olefins, referred to as polyalphaolefins or PAO's or Group IV base stocks [according to the API EOLCS 1509 definition (American Petroleum Institute Publication 1509, see section E.1.3, 19th edition, January 2021, www.API.org)]. Examples of PAO's useful as base stocks include: poly(ethylenes), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or $C_{12}$ alkenes, $C_8/C_{10}$ copolymers, $C_8/C_{10}/C_{12}$ copolymers, and $C_{10}/C_{12}$ copolymers, and the derivatives, analogues and homologues thereof.

In another embodiment, the base stock may comprise polyalphaolefins comprising oligomers of linear olefins having 6 to 14 carbon atoms, such as 8 to 12 carbon atoms, such as 10 carbon atoms having a Kinematic viscosity at 100° C. of 10 or more (as measured by ASTM D445); and having a viscosity index ("VI"), as determined by ASTM D2270, of 100 or more, such as 110 or more, such as 120 or more, such as 130 or more, such as 140 or more; and/or having a pour point of −5° C. or less (as determined by ASTM D97), such as −10° C. or less, such as −20° C. or less.

In another embodiment, polyalphaolefin oligomers useful in the present disclosure may comprise $C_{20}$ to $C_{1500}$ paraffins, such as $C_{40}$ to $C_{1000}$ paraffins, such as $C_{50}$ to $C_{750}$ paraffins, such as $C_{50}$ to $C_{500}$ paraffins. The PAO oligomers are dimers, trimers, tetramers, pentamers, etc., of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene, and 1-dodecene. In one embodiment, the olefin is a combination of 1-octene, 1-decene, and 1-dodecene, or such as may be substantially 1-decene, and the PAO is a mixture of dimers, trimers, tetramers, and pentamers (and higher) thereof. Useful PAO's are described more particularly in, for example, U.S. Pat. Nos. 5,171,908 and 5,783,531, and in Synthetic Lubricants and High-Performance Functional Fluids, 1-52 (Leslie R. Rudnick & Ronald L. Shubkin, ed. Marcel Dekker, Inc. 1999).

Polyalphaolefins useful in the present disclosure typically possess a number average molecular weight of from 100 to 21,000 g/mol in one embodiment, such as from 200 to 10,000 g/mol in another embodiment, such as from 200 to 7,000 g/mol in yet another embodiment, such as from 200 to 2,000 g/mol in yet another embodiment, and such as from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn™ PAO's from Ineos Oligomers USA LLC.

Synthetic lubricating oils useful as base stocks also include hydrocarbon oils such as homopolymerized and copolymerized: alkylbenzenes (e.g., dodecylbenzenes, tetradecylbenzenes, dinonylbenzenes, di(2-ethylhexyl)benzenes); polyphenols (e.g., biphenyls, terphenyls, alkylated polyphenols); and alkylated diphenyl ethers, and alkylated diphenyl sulfides; and the derivatives, analogues, and homologues thereof.

Another suitable class of synthetic lubricating oils useful as base stocks comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol, and tripentaerythritol.

Desirable ester base stocks are commercially available as Esterex™ Esters (ExxonMobil Chemical Company).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes, and poly(methylphenyl)-siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the LOC of the present disclosure. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. Such re-refined oils are absent from the LOCs in an embodiment.

Other examples of useful base stocks are gas-to-liquid ("GTL") base stocks, i.e., the base stock is an oil derived from hydrocarbons made from synthesis gas ("syn gas") containing $H_2$ and CO using a Fischer-Tropsch catalyst. These hydrocarbons typically require further processing in order to be useful as a base stock. For example, they may, by methods known in the art, be hydroisomerized; hydrocracked and hydroisomerized; dewaxed; or hydroisomerized and dewaxed. For further information on useful GTL base stocks and blends thereof, please see U.S. Pat. No. 10,913,916 (col 4, In 62 to col 5, In 60) and U.S. Pat. No. 10,781,397 (col 14, In 54 to col 15, In 5, and col 16, In 44 to col 17, In 55).

In any embodiment, oils from renewable sources, i.e., based in part on carbon and energy captured from the environment, such as biological sources, are useful herein.

The various base stocks are often categorized as Group I, II, III, IV, or V according to the API EOLCS 1509 definition (American Petroleum Institute Publication 1509, see section E.1.3, 19th edition, January 2021, www.API.org). In an embodiment the Group I base stocks have a viscosity index of between 80 to 120 and contain greater than 0.03% sulfur and/or less than 90% saturates. Group II base stocks have a viscosity index of between 80 to 120 and contain less than or equal to 0.03% sulfur and greater than or equal to 90% saturates. Group III base stocks have a viscosity index greater than 120 and contain less than or equal to 0.03% sulfur and greater than 90% saturates. Group IV base stocks includes polyalphaolefins (PAO). Group V base stocks include base stocks not included in Groups I-IV. (Viscosity index measured by ASTM D 2270, saturates is measured by ASTM D2007, and sulfur is measured by ASTM D5185, D2622, ASTM D4294, ASTM D4927, and ASTM D3120).

Base stocks for use in the formulated LOC useful in the present disclosure are any one, two, three, or more of the variety of oils described herein. In desirable embodiments, base stocks for use in the formulated LOC useful in the present disclosure are those described as API Group I, Group II, Group III (including Group III+), Group IV, and Group V oils and mixtures thereof, such as API Group II, Group III, Group IV, and Group V oils and mixtures thereof, such as the Group III, Group III+, IV, and Group V base stocks due to their exceptional volatility, stability, viscometric, and cleanliness features. Minor quantities of Group I base stock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is more useful that the Group II base stock be in the higher quality range associated with that stock, i.e., a Group II stock having a viscosity index in the range from 100 to 120.

The base stock useful herein may be selected from any of the synthetic, natural, or re-refined oils (such as those typically used as crankcase lubricating oils for spark-ignited and compression-ignited engines). Mixtures of synthetic and/or natural and/or re-refined base stocks may be used if desired. Multi-modal mixtures (such as bi- or tri-modal mixtures) of Group I, II, III, IV, and/or V base stocks may be used if desired.

The base stock or base stock blend used herein conveniently has a kinematic viscosity at 100° C. (KV100, as measured according to ASTM D445-19a, and reported in units 30 of centistoke (cSt) or it its equivalent, $mm^2/s$), of 2 to 40 cSt, such as of 3 to 30 cSt, such as 4 to 20 cSt at 100° C., such as 5 to 10 cSt, such as the base stock or base stock blend may have a kinematic viscosity at 100° C. of 2 to 20 cSt, of 2.5 to 2 cSt, and such as of 2.5 cSt to 9 cSt.

In an embodiment the base stock or base stock blend has a saturate content of at least 65 mass %, such as at least 75 mass %, such as at least 85 mass %, such as at least 90 mass % as determined by ASTM D2007.

In an embodiment the base stock or base stock blend will have a sulfur content of less than 1 mass %, such as less than 0.6 mass %, such as less than 0.4 mass %, such as less than 0.3 mass %, based on the total mass of the lubricating composition, as measured by ASTM D5185.

In any embodiment, the viscosity index (VI) of the base stock is at least 95, such as at least 110, such as at least 120, even such as at least 125, such as from 130 to 240, such as from 105 to 140 (as determined by ASTM D2270).

The base stock may be provided in a major amount, or in combination with a minor amount of one or more additive components as described herein. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base stock may be provided in a minor amount, in combination with minor amounts of one or more additive components as described hereinafter, constituting an additive concentrate. This preparation may be accomplished by adding the additives directly to the oil or by adding the one or more additives in the form of a solution, slurry or suspension thereof to disperse or dissolve the additive(s) in the oil. Additives may be added to the oil by any method known to those skilled in the art, either before, at the same time as, or after addition of other additives.

The base stock typically constitutes the major component of an engine oil LOC of the present disclosure and typically is present in an amount ranging from 50 to 99 wt %, such as from 70 to 95 wt %, and such as from 80 to 95 wt %, based on the total weight of the composition.

The base stocks and blends thereof described above are also useful for making concentrates as well as for making lubricants therefrom.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (or "addpack") comprising one or more additives/co-additives, such as described hereinafter, in a single concentrate.

Typically, one or more base stocks are present in the concentrate composition in an amount of 50 wt % or less, such as 40 wt % or less, such as 30 wt % or less, such as 20 wt % or less, based on the total weight of the concentrate composition. Typically, one or more base stocks are present in the concentrate composition at an amount of 0.1 to 49 mass %, such as 5 to 40 mass %, such as to 10 to 30 mass %, such as 15 to 25 mass %, based upon the weight of the concentrate composition.

Additives

A mentioned above, the lubricating composition according to the present disclosure may further comprise one or more additives such as detergents, friction modifiers, antioxidants, pour point depressants, anti-foam agents, viscosity modifiers, dispersants, corrosion inhibitors, antiwear agents, extreme pressure additives, demulsifiers, seal compatibility agents, additive diluent base stocks, etc. Specific examples of such additives are described in, for example, Kirk-Othmer Encyclopedia of Chemical Technology, $3^{rd}$ ed., 14, 477-526 (1978), and several are discussed in further detail below.

In any embodiment the LOC may comprise one or more metal detergents (such as blends of metal detergents) also referred to as a "detergent additive." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mgKOH/g, such as from 0 to 80 (or 5-30) mgKOH/g. A large amount of a metal base may be incorporated by reacting excess metal compound (e.g., an oxide or hydroxide) with an acidic gas (e.g., carbon dioxide). Such detergents, sometimes referred to as "overbased" may have a TBN of 100 mgKOH/g or more (such as 200 mgKOH/g or more), and typically will have a TBN of 250 mgKOH/g or more, such as 300 mgKOH/g or more, such as from 200 to 800 mgKOH/g, 225 to 700 mgKOH/g, 250 to 650 mgKOH/g, or 300 to 600 mgKOH/g, such as 150 to 650 mgKOH/g.

Suitable detergents include, oil-soluble neutral and overbased sulfonates, phenates, sulfurized phenates, thiophosphonates, salicylates, naphthenates and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba), particularly, sodium, potassium, lithium, calcium, and magnesium, such as Ca and/or Mg. Furthermore, the detergent may comprise a hybrid detergent comprising any combination of sodium, potassium, lithium, calcium, or magnesium salts of sulfonates, phenates, sulfurized phenates, thiophosphonates, salicylates, and naphthenates or other oil-soluble carboxylates of a Group 1 and/or 2 metal.

In an embodiment the detergent additive(s) useful in the present disclosure comprises calcium and/or magnesium metal salts. The detergent may be a calcium and/or magnesium carboxylate (e.g., salicylates), sulfonate, or phenate detergent. In any embodiment, the detergent additives are selected from magnesium salicylate, calcium salicylate, magnesium sulfonate, calcium sulfonate, magnesium phenate, calcium phenate, and hybrid detergents comprising two, three, four, or more of more of these detergents and/or combinations thereof.

The metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The overbased metal-containing detergent may be sodium salts, calcium salts, magnesium salts, or mixtures thereof of the phenates, sulfur-containing phenates, sulfonates, salixarates, and salicylates. Overbased phenates and salicylates typically have a total base number of 180 to 650 mgKOH/g, such as 200 to 450 TBN mgKOH/g. Overbased sulfonates typically have a total base number of 250 to 600 mgKOH/g, or 300 to 500 mgKOH/g. In any embodiment, the sulfonate detergent may be predominantly a linear alkylbenzene sulfonate detergent having a metal ratio of at least 8 as is described in paragraphs to of US Patent Application Publication No. 2005/065045 (and granted as U.S. Pat. No. 7,407,919). The overbased detergent may be present from 0 wt % to 15 wt %, or from 0.1 wt % to 10 wt %, or from 0.2 wt % to 8 wt %, or from 0.2 wt % to 3 wt %, based upon of the lubricating composition. For example, in a heavy-duty diesel engine, the detergent may be present from 2 wt % to 3 wt % of the lubricating composition. For a passenger car engine, the detergent may be present from 0.2 wt % to 1 wt % of the lubricating composition.

The detergent additive(s) may comprise one or more magnesium sulfonate detergents. The magnesium detergent may be a neutral salt or an overbased salt. Suitably the magnesium detergent is an overbased magnesium sulfonate having a TBN of from 80 to 650 mgKOH/g (ASTM D2896), such as from 200 to 500 mgKOH/g, such as from 240 to 450 mgKOH/g.

In an embodiment the detergent additive(s) is magnesium salicylate, which may have a TBN of from 30 to 650 mgKOH/g (ASTM D2896), such as from 50 to 500 mgKOH/g, such as from 200 to 500 mgKOH/g, such as from 240 to 450 mgKOH/g or such as 150 mgKOH/g or less, such as 100 mgKOH/g or less.

In some embodiments the magnesium detergent provides the lubricating composition thereof with from 200-4000 ppm of magnesium atoms, suitably from 200-2000 ppm, from 300 to 1500 or from 450-1200 ppm of magnesium atoms (ASTM D5185).

The detergent composition may comprise (or consist of) a combination of one or more magnesium sulfonate detergents and one or more calcium salicylate detergents. The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 ppm or from 450-1200 ppm of magnesium atoms (ASTM D5185), and 2) at least 500 ppm, such as at least 750 ppm, such as at least 900 ppm of atomic calcium, such as from 500-4000 ppm, such as from 750-3000 ppm, such as from 900-2000 ppm atomic calcium (ASTM D5185).

The detergent may comprise one or more calcium detergents such as calcium carboxylate (e.g., salicylate), sulfonate, or phenate detergent.

Suitably the calcium detergent (such as calcium salicylate, sulfonate, or phenate) has a TBN of from 30 to 700 mgKOH/g (ASTM D2896), such as from 50 to 650 mgKOH/g, such as from 200 to 500 mgKOH/g, such as from 240 to 450 mgKOH/g or such as of from 150 mgKOH/g or less, such as from 100 mgKOH/g or less, or 200 mgKOH/g or more, or 300 mgKOH/g or more, or 350 mgKOH/g or more.

Calcium detergent is typically present in amount sufficient to provide at least 500 ppm, such as at least 750, such as at least 900 ppm atomic calcium to the LOC (ASTM D5185). If present, any calcium detergent is suitably present in amount sufficient to provide no more than 4000 ppm, such as no more than 3000 ppm, such as no more than 2000 ppm atomic calcium to the LOC (ASTM D5185). If present, any calcium detergent is suitably present in amount sufficient to provide at from 500-4000 ppm, such as from 750-3000 ppm such as from 900-2000 ppm atomic calcium to the LOC (ASTM D5185).

Suitably the total atomic amount of metal from detergent in the lubrication composition according to all aspects of the disclosure is no more than 5000 ppm, such as no more than 4000 μm and such as no more than 2000 ppm (ASTM D5185). The total amount of atomic metal from detergent in the lubrication oil composition according to all aspects of the disclosure is suitably at least 500 ppm, such as at least 800 ppm and such as at least 1000 ppm (ASTM D5185). The total amount of atomic metal from detergent in the lubrication oil composition according to all aspects of the disclosure is suitably from 500 to 5000 ppm, such as from 500 to 3000 ppm and such as from 500 to 2000 ppm (ASTM D5185).

Further, as metal organic and inorganic base salts, which are used as detergents can contribute to the sulfated ash content of a LOC, the amounts of such additives are preferably minimized. In order to maintain a low sulfur level, salicylate detergents can be used and the lubricating composition herein may comprise one or more salicylate detergents (said detergents are used in amounts in the range of 0.05 to 20.0 wt %, such as from 1.0 to 10.0 wt % and such as in the range of from 2.0 to 5.0 wt %, based on the total weight of the lubricating composition).

In any embodiment the LOC may include a friction modifier additive. A friction modifier is any material or materials that can alter the coefficient of friction of a surface lubricated by any lubricant or fluid-containing such material (s). Friction modifiers, also known as friction reducers, or lubricity agents or oiliness agents, and other such agents that change the ability of base stocks, formulated LOC, or functional fluids, to modify the coefficient of friction of a lubricated surface may be effectively used in combination with the base stocks or LOC of the present disclosure if desired. Friction modifiers that lower the coefficient of friction are particularly advantageous in combination with the base stocks and LOC of this disclosure.

Illustrative friction modifiers may include, for example, organometallic compounds or materials, or mixtures thereof. Illustrative organometallic friction modifiers useful in the lubricating oil formulations of this disclosure include, for example, tungsten and/or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds may conveniently include molybdenum dithiocarbamates, and trinuclear molybdenum compounds.

Other known friction modifiers comprise oil-soluble organo-molybdenum compounds. Such organo-molybdenum friction modifiers may also provide antioxidant and antiwear credits to a LOC. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D664 or D2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOC_{14}$, $MoO_2Br_2$, $Mo_2O_3C_{16}$, molybdenum trioxide or similar acidic molybdenum compounds.

Among the molybdenum compounds useful in the compositions of this disclosure are organo-molybdenum compounds of the formula $Mo(R''OCS_2)_4$ and $Mo(R''SCS_2)_4$, wherein R" is an hydrocarbyl group selected from the group consisting of alkyl, aryl, aralkyl and alkoxyalkyl, generally of from 1 to 30 carbon atoms, and such as from 2 to 12 carbon atoms and such as alkyl of from 2 to 12 carbon atoms. Especially preferred are the dialkyldithiocarbamates of molybdenum.

Another group of organo-molybdenum compounds useful in the LOC of this disclosure are trinuclear molybdenum compounds, especially those of the formula $Mo_3S_kL_nQ_z$ and mixtures thereof wherein the L are independently selected ligands having hydrocarbyl groups with a sufficient number of carbon atoms to render the compound soluble or dispersible in the oil, n is from 1 to 4, k varies from 4 to 7, Q is selected from the group of neutral electron-donating compounds such as water, amines, alcohols, phosphines, and ethers, and z ranges from 0 to 5 and includes non-stoichiometric values. At least 21 carbon atoms should be present among all the groups, such as at least 25, at least 30, or at least 35 carbon atoms.

LOCs useful in all aspects of the present disclosure may contain at least 10 ppm, at least 30 ppm, at least 40 ppm and such as at least 50 ppm molybdenum. Suitably, LOC useful in all aspects of the present disclosure contain no more than 1000 ppm, no more than 750 ppm, or no more than 500 ppm of molybdenum. LOCs useful in all aspects of the present disclosure such as contain from 10 to 1000, such as 30 to 750 or 40 to 500, ppm of molybdenum (measured as atoms of molybdenum).

Illustrative friction modifiers useful in the LOC described herein include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, polyethoxylated hydrocarbylamides, polypropoxylated hydrocarbylamides, and the like.

Illustrative polyol fatty acid esters include, for example, glycerol monooleate, saturated mono-, di-, and tri-glyceride esters, glycerol monostearate, and the like. These can include polyol esters, hydroxyl-containing polyol esters, and the like.

Illustrative borated glycerol fatty acid esters include, for example, borated glycerol monooleate, borated saturated mono-, di-, and triglyceride esters, borated glycerol monostearate, and the like. In addition to glycerol polyols, these can include trimethylolpropane, pentaerythritol, sorbitan, and the like. These esters can be polyol monocarboxylate esters, polyol dicarboxylate esters, and polyoltricarboxylate esters. Preferred can be the glycerol monooleates, glycerol di-oleates, glycerol tri-oleates, glycerol mono-oleates, glycerol di-stearates, and glycerol tri-stearates and the corresponding glycerol mono-palmitates, glycerol di-palmitates, and glycerol tri-palmitates, and the respective isostearates, linoleates, and the like. Ethoxylated, propoxylated, and/or butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can be stearyl, myristyl, $C_{11}$-$C_{13}$ hydrocarbon, oleyl, isostearyl, and the like.

Useful concentrations of friction modifiers may range from 0.01 wt % to 5 wt %, or from 001 wt % to 2.5 wt %, or from 0.05 wt % to 1.5 wt %, or from 0.051 wt % to 1 wt %. Concentrations of molybdenum-containing materials are often described in terms of Mo metal concentration. Advantageous concentrations of Mo may range from 25 ppm to 700 ppm or more, and often with a preferred range of from 50 to 200 ppm. Friction modifiers of all types may be used alone or in mixtures with the materials of this disclosure. Often mixtures of two or more friction modifiers, or mixtures of friction modifier(s) with alternate surface-active material(s), are also desirable. For example, combinations of Mo-containing compounds with polyol fatty acid esters, such as glycerol mono-oleate are useful herein.

In any embodiment the LOC may include an antioxidant additive. Antioxidants retard the oxidative degradation of base stocks during service. Such degradation may result in deposits on metal surfaces, the presence of sludge, an increase in the viscosity of a lubricant, and the like. A wide variety of oxidation inhibitors that are useful in LOC. See, Lubricants and Related Products, Deiter Klamann, Wiley VCH, (1984); U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are hindered phenolics, which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic propionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include, for example, 4,4'-bis (2,6-di-t-butyl-phenol) and 4,4'-methylene-bis(2,6-di-t-butyl-phenol).

Effective amounts of one or more catalytic antioxidants may also be used. The catalytic antioxidants comprise an effective amount of a) one or more oil soluble polymetal organic compounds; and effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors, which may be used include aromatic amine antioxidants and these may be used either as such or in combination with phenolics. Typical examples of non-phenolic antioxidants include: alkylated and non-alkylated aromatic amines such as aromatic monoamines.

Sulfur-containing antioxidants are also useful herein. In any embodiment, one or more oil-soluble or oil-dispersible sulfur-containing antioxidant(s) can be used as an antioxidant additive. For example, sulfurized alkyl phenols and alkali or alkaline earth metal salts thereof also are useful antioxidants herein. Suitably, the LOC(s) of the present disclosure may include the one or more sulfur-containing antioxidant(s) in an amount to provide the LOC with from 0.02 to 0.2, such as from 0.02 to 0.15, even such as from 0.02 to 0.1, even such as from 0.04 to 0.1, mass % sulfur based on the total mass of the LOC. Optionally the oil-soluble or oil-dispersible sulfur-containing antioxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic antioxidant(s), sulfur-containing organo-molybdenum compound(s), and combinations thereof.

Antioxidants useful herein include hindered phenols and/or arylamines. These antioxidants may be used individually by type or in combination with one another. Typical antioxidants include: Irganox™ L67, Ethanox™ 4702, Lanxess Additin™ RC 7110; Ethanox™ 4782J; Irganox™ 1135, Irganox™ 5057, sulfurized lard oil and palm oil fatty acid methyl ester.

Antioxidant additives may be used in an amount of 0.01 to 10 (such as 0.01 to 5, such as from 0.01 to 3) wt %, such as from 0.03 to 5 wt %, such as from 0.05 to less than 3 wt %, based upon the weight of the lubricating composition.

Compositions according to the present disclosure may contain an additive having a different enumerated function that also has secondary effects as an antioxidant (for example, phosphorus-containing antiwear agents (such as ZDDP) may also have antioxidant effects). These additives are not included as antioxidants for purposes of determining the amount of antioxidant in a LOC or concentrate herein.

In any embodiment the LOC may include a pour point depressant additive. Conventional pour point depressants (also known as lube oil flow improvers) may be added to the compositions of the present disclosure if desired. These pour point depressants may be added to LOC of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of 0.01 to 5 wt %, such as 0.01 to 1.5 wt %, based upon the weight of the LOC.

In any embodiment the LOC may include a anti-foam additive. Anti-foam agents may advantageously be added to LOCs described herein. These agents prevent or retard the formation of stable foams. Silicones and/organic polymers are typical anti-foam agents. For example, polysiloxanes, such as silicon oil or polydimethyl siloxane, provide anti-foam properties.

Anti-foam agents are commercially available and may be used in minor amounts such as 5 wt % or less, 3 wt % or less, 1 wt % or less, 0.1 wt % or less, such as from 5 to wt % to 0.1 ppm such as from 3 wt % to 0.5 ppm, such as from 1 wt % to 10 ppm.

For example, it may be that the LOC comprises an anti-foam agent comprising polyalkyl siloxane, such as a polydialkyl siloxane, for example, wherein the alkyl is a $C_1$-$C_{10}$ alkyl group, e.g., a polydimethylsiloxane (PDMS), also known as a silicone oil. In any embodiment, the siloxane is a poly(R)siloxane, wherein R is one or more same or different linear, branched or cyclic hydrocarbyls such as alkyls or aryls, typically having 1 to 20 carbon atoms. It may be that, for example, the LOC comprises a polymeric siloxane compound independently substituted by methyl, ethyl, propyl, butyl, pentyl, hexyl, heptyl, octyl, nonyl or decyl, phenyl, naphthyl, or alkyl substituted phenyl groups or isomers thereof (such as methyl, phenyl) and n is from 2 to 1000, such as 50 to 450, such as such as 40 to 100.

Additionally, or alternatively, it may be that the LOC comprises an organo-modified siloxane (OMS), such as a siloxane modified with an hydrocarbyl group such as a polyether (e.g., ethylene-propyleneoxide copolymer), long chain hydrocarbyl (e.g., $C_{11}$-$C_{100}$ alkyl), or aryl (e.g., $C_6$-$C_{14}$ aryl). It may be that, for example, the LOC comprises an organo-modified siloxane compound.

Based on the total weight of the LOC, the siloxane may be incorporated so as to provide 0.1 to less than 30 ppm Si, or 0.1 to 25 ppm Si, or from 0.1 to 20 ppm Si, or from 0.1 to 15 ppm Si, or from 0.1 to 10 ppm Si.

In any embodiment, silicone anti-foam agents useful herein are available from Dow Corning Corporation and Union Carbide Corporation, such as Dow Corning FS-1265 (1000 centistokes), Dow Corning DC-200, and Union Carbide UC-L45. Silicone anti-foamants useful herein include polydimethylsiloxane, phenyl-methyl polysiloxane, linear, cyclic or branched siloxanes, silicone polymers and copolymers, and/organo-silicone copolymers. Also, a siloxane polyether copolymer anti-foamant available from OSI Specialties, Inc. of Farmington Hills, Michigan and may be substituted or included. One such material is sold as SILWET-L-7220.

Acrylate polymer anti-foam agent can also be used herein. Typical acrylate anti-foamants include polyacrylate anti-foamant available from Monsanto Polymer Products Co. known as PC-1244. A preferred acrylate polymer anti-foam agent useful herein is PX™3841 (i.e., an alkyl acrylate polymer), commercially available from Dorf Ketal Chemicals, also referred to as Mobilad™ C402.

In any embodiment the LOC may include a viscosity modifier. Viscosity modifiers (also referred to as viscosity index improvers or viscosity improvers) can be included in the LOC described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers.

Copolymers useful as viscosity modifiers include those commercially available from Chevron Oronite Company LLC under the trade designation "Paratone™" (such as "Paratone™ 8921", "Paratone™ 68231", and "Paratone™ 8941"); from Afton Chemical Corporation under the trade designation "HiTEC™" (such as HiTEC™ 5850B, and HiTEC™5777); and from The Lubrizol Corporation under the trade designation "Lubrizol™ 7067C". Hydrogenated polyisoprene star polymers useful as viscosity modifiers herein include those commercially available from Infineum International Limited, e.g., under the trade designation "SV200™" and "SV600™". Hydrogenated diene-styrene block copolymers useful as viscosity modifiers herein are commercially available from Infineum International Limited, e.g., under the trade designation "SV 50™".

Polymers useful as viscosity modifiers herein include polymethacrylate or polyacrylate polymers, such as linear polymethacrylate or polyacrylate polymers, such as those available from Evonik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol™ 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer (such as isoprene).

Vinyl aromatic-containing polymers useful as viscosity modifiers may have a Kinematic viscosity at 100° C. of 20 cSt or less, such as 15 cSt or less, such as 12 cSt or less, but may be diluted (such as in Group I, II, and/or III base stock) to higher Kinematic viscosities at 100° C., such as to 40 cSt or more, such as 100 cSt or more, such as 1000 cSt or more, such as 1000 to 2000 cSt).

Typically, the viscosity modifiers may be used in an amount of from 0.01 to 10 wt %, such as from 0.1 to 7 wt %, such as from 0.1 to 4 wt %, such as from 0.2 to 2 wt %, such as from 0.2 to 1 wt %, and such as from 0.2 to 0.5 wt %, based on the total weight of the formulated LOC.

Viscosity modifiers are typically added as concentrates, in large amounts of diluent oil. The "as delivered" viscosity modifier typically contains from 20 wt % to 75 wt % of an active polymer for polymethacrylate or polyacrylate polymers, or from 8 wt % to 20 wt % of an active polymer for olefin copolymers, hydrogenated polyisoprene star polymers, or hydrogenated diene-styrene block copolymers, in the "as delivered" polymer concentrate.

The LOC described herein may include dispersants other than the inventive functionalized olefinic polymers. During engine operation, oil-insoluble oxidation byproducts are produced. Dispersants help keep these byproducts in solution, thus diminishing their deposition on metal surfaces. Dispersants used in the formulation of the LOC herein may be ashless or ash-forming in nature. In an embodiment the dispersant is ashless. So called ashless dispersants are organic materials that form substantially no ash upon combustion. For example, non-metal-containing or borated metal-free dispersants are considered ashless. In contrast, metal-containing detergents tend to form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 40 to 500, such as 50 to 400 carbon atoms.

A particularly useful class of dispersants includes the (poly)alkenylsuccinic derivatives, typically produced by the reaction of a long chain hydrocarbyl-substituted succinic compound, usually a hydrocarbyl-substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of from 400 to 3000 g/mol, such as from 450 to 2500 g/mol). Many examples of this type of dispersant are well known commercially and in the literature.

Hydrocarbyl-substituted succinic acid and hydrocarbyl-substituted succinic anhydride derivatives are useful dispersants. In any embodiment, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 to 4000 g/mol, such as from 800 to 3000, such as from 2000 to 2800 g/mol, such from 2100 to 2500 g/mol, and such as from 2200 to 2400 g/mol.

Succinimides, which are particularly useful herein, are formed by the condensation reaction between: 1) hydrocarbyl-substituted succinic anhydrides, such as polyisobutylene succinic anhydride (PIBSA); and 2) polyamine (PAM). Examples of suitable polyamines include: polyhydrocarbyl polyamines, polyalkylene polyamines, hydroxy-substituted polyamines, polyoxyalkylene polyamines, and combinations thereof. Examples of polyamines include tetraethylene pentamine, pentaethylene hexamine, tetraethylenepentamine (TEPA), pentaethylenehexamine (PEHA), N-phenyl-p-phenylenediamine (ADPA), and other polyamines having an average of 5, 6, 7, 8, or 9 nitrogen atoms per molecule. Mixtures where the average number of nitrogen atoms per polyamine molecule is greater than 7 are commonly called heavy polyamines or H-PAMs and may be commercially available under trade names such as HPA™ and HPA-X™ from Dow Chemical Company, E-100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl) piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from 200 to 5000 g/mol. Products of this type are commercially available under the tradename Jeffamine™ from Huntsman International.

The dispersants may comprise one or more, optionally borated, higher molecular weight (Mn of 1600 g/mol or more, such as from 1800 to 3000 g/mol) succinimides and one or more, optionally borated, lower molecular weight (Mn less than 1600 g/mol) succinimides, where the higher molecular weight may be from 1600 to 3000 g/mol, such as from 1700 to 2800 g/mol, such as from 1800 to 2500 g/mol, such as from 1850 to 2300 g/mol; and the lower molecular weight may be 600 to less than 1600 g/mol, such as from 650 to 1500 g/mol, such as from 700 to 1400 g/mol, such as from 800 to 1300 g/mol, such as from 850 to 1200 g/mol such as from 900 to 1150 g/mol, such as from 900 to 1000 g/mol. The higher molecular weight succinimide dispersant may be present in the lubricating composition in an amount of from 0.5 to 10 wt %, or from 0.8 to 6 wt %, or from 1.0 to 5 wt %, or from 1.5 to 5 wt %, or from 1.5 to 4.0 wt %; and the lower molecular weight succinimides dispersant may be present in the lubricating composition in an amount of from 1 to 5 wt %, or from 1.5 to 4.8 wt %, or from 1.8 to 4.6 wt %, or from 1.9 to 4.6 wt %, or at 2 wt % or more, such as 2 to 5 wt %. The lower molecular weight succinimides may differ from the higher molecular weight succinimides, by 500 g/mol or more, such as by 750 g/mol or more, such as by 1000 g/mol or more.

Succinate esters useful as dispersants include those formed by the condensation reaction between hydrocarbyl-substituted succinic anhydrides and alcohols or polyols. For example, the condensation product of a hydrocarbyl-substituted succinic anhydride and pentaerythritol is a useful dispersant.

Succinate ester amides useful herein are formed by a condensation reaction between hydrocarbyl-substituted succinic anhydrides and alkanol amines. Suitable alkanol amines include ethoxylated polyalkylpolyamines, propoxylated polyalkylpolyamines, and polyalkenylpolyamines such as polyethylene polyamines and/or propoxylated hexamethylenediamine.

Hydrocarbyl-substituted succinic anhydrides (such as PIBSA) esters of hydrocarbyl bridged aryloxy alcohols are also useful as dispersants herein. In any embodiment, PIBSA esters of methylene-bridged naphthyloxy ethanol (i.e., 2-hydroxyethyl-1-naphthol ether (or hydroxy-terminated ethylene oxide oligomer ether of naphthol) are useful herein.

The molecular weight of the hydrocarbyl-substituted succinic anhydrides used in the preceding paragraphs will typically range from 350 to 4000 g/mol, such as from 400 to 3000 g/mol, such as from 450 to 2800 g/mol, such as from 800 to 2500 g/mol. The above (poly)alkenylsuccinic derivatives can be post-reacted with various reagents such as sulfur, oxygen, formaldehyde, carboxylic acids such as oleic acid.

The dispersants may be present in the lubricant in an amount from 0.1 mass % to 20 mass % of the composition, such as from 0.2 to 15 mass %, such as from 0.25 to 10 mass %, such as from 0.3 to 5 mass %, such as from 1.0 mass % to 3.0 mass %, of the LOC.

The above (poly)alkenylsuccinic derivatives, can also be post reacted with boron compounds such as boric acid, borate esters or highly borated dispersants, to form borated dispersants generally having from 0.1 to 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having an Mn of from 300 to 5000 g/mol, or from 500 to 3000 g/mol, or 1000 to 2000 g/mol, or a mixture of such hydrocarbylene groups, often with high terminal vinylic groups.

The boron-containing dispersant may be present from 0.01 wt % to 20 wt %, or from 0.1 wt % to 15 wt %, or from 0.1 wt % to 10 wt % of the lubricating composition.

The boron-containing dispersant may be present in an amount to deliver boron to the composition from 15 ppm to 2000 ppm, or from 25 ppm to 1000 ppm, or from 40 ppm to 600 ppm, or from 80 ppm to 350 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be from 0.01 wt % to 20 wt %, or from 0.1 wt % to 15 wt %, or from 0.1 wt % to 10 wt % of the lubricating composition and wherein the ratio of borated dispersant to non-borated dispersant may be from 1:10 to 10:1 (weight:weight) or from 1:5 to 3:1 or from 1:3 to 2:1.

The dispersant may comprise one or more borated or non-borated poly(alkenyl)succinimides, where the polyalkyenyl is derived from polyisobutylene and the imide is derived from a polyamine ("PIBSA-PAM").

The dispersant may comprise one or more PIBSA-PAMs, where the PIB is derived from polyisobutylene having an Mn of from 600 to 5000, such as from 700 to 4000, such as from 800 to 3000, such as from 900 to 2500 g/mol and the polyamine is derived from hydrocarbyl-substituted polyamines, such as tetraethylene pentamine, pentaethylene hexamine, tetraethylenepentamine (TEPA), pentaethylenehexamine (PEHA), N-phenyl-p-phenylenediamine (ADPA), and other polyamines having an average of 5, 6, 7, 8, or 9 nitrogen atoms per molecule). The dispersant may be borated, typically at levels of up to 4 mass % such as from 1 to 3 mass %. The dispersant may comprise one or more borated and one or more non-borated PIBSA-PAM's. The dispersant may comprise one or more borated PIBSA-PAM's derived from a PIB having an Mn of from 700 to 1800 g/mol (such as from 800 to 1500 g/mol) and one or more non-borated PIBSA-PAM's derived from a PIB having an Mn of from 1800 to 5000 g/mol (such as from 2000 to 3000 g/mol). The dispersant may comprise one or more non-borated PIBSA-PAM's derived from a PIB having an Mn of from 700 to 1800 g/mol (such as from 800 to 1500 g/mol) and one or more borated PIBSA-PAM's derived from a PIB having an Mn of more than from 1800 to 5000 g/mol (such as 2000 to 3000 g/mol).

The dispersant may comprise one or more, optionally borated, higher molecular weight (Mn 1600 g/mol or more, such as from 1800 to 3000 g/mol) PIBSA-PAM's and one or more, optionally borated, lower molecular weight (Mn less than 1600 g/mol) PIBSA-PAM's, where the higher molecular weight may be from 1600 to 3000 g/mol, such as from 1700 to 2800 g/mol, such as from 1800 to 2500 g/mol, such as from 1850 to 2300 g/mol; and the lower molecular weight may be 600 to less than 1600 g/mol, such as from 650 to 1500 g/mol, such as from 700 to 1400 g/mol, such as from 800 to 1300 g/mol, such as from 850 to 1200 g/mol, such as from 900 to 11500 g/mol, such as from 900 to 100 g/mol. The higher molecular weight PIBSA-PAM dispersant may be present in the lubricating composition in an amount of from 0.5 to 10 wt %, or from 0.8 to 6 wt %, or from 1.0 to 5 wt %, or from 1.5 to 5 wt % or from 1.5 to 4.0 wt %; and the lower molecular weight PIBSA-PAM dispersant may be present in the lubricating composition in an amount of from 1 to 5 wt %, or from 1.5 to 4.8 wt %, or from 1.8 to 4.6 wt %, or from 1.9 to 4.6 wt %, or at 2 wt % or more, such as 2 to 5 wt %.

In any embodiment the LOC may include a corrosion inhibitor and/or an anti-rust agent. Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur-containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole wherein the rings may be substituted in any position by a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to 20 carbon atoms or from 1 to 8 carbon atoms. Non-limiting examples of such corrosion inhibitors may comprise or be benzotriazole, tolyltriazole, and/or optionally, substituted benzotriazoles such as Irgamet™ 39, which is commercially available from BASF. A preferred corrosion inhibitor may comprise or be benzotriazole and/or tolyltriazole.

Additionally, or alternatively, the corrosion inhibitor may include one or more substituted thiadiazoles which may be substituted by groups aliphatic or aromatic groups including cyclic, alicyclic, aralkyl, aryl and alkaryl, and wherein each w is independently 1, 2, 3, 4, 5, or 6 (such as 2, 3, or 4). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure.

Further, additionally, or alternatively, the corrosion inhibitor may include one or more other derivatives of DMTD, such as a carboxylic ester in which $R_{15}$ and $R_{16}$ may be joined to the sulfide sulfur atom through a carbonyl group. DMTD derivatives can be produced by condensation of DMTD with alpha-halogenated aliphatic carboxylic acids having at least 10 carbon atoms. This process produces DMTD derivatives wherein $R_{15}$ and $R_{16}$ are HOOC—CH($R_{19}$)—($R_{19}$ being a hydrocarbyl group). DMTD derivatives further produced by amidation or esterification of these terminal carboxylic acid groups may also be useful.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company. A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further, the corrosion inhibitor may include a trifunctional borate having the structure, $B(OR_{46})_3$, in which each $R_{46}$ may be the same or different. As the borate May typically be desirably compatible with the non-aqueous medium of the composition, each $R_{46}$ may, In any embodiment, comprise or be a hydrocarbyl $C_1$-$C_8$ moiety. For compositions in which the non-aqueous medium comprises or is a base stock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl) borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from 0.001 wt % to 5.0 wt %, based on the weight of the composition from 0.005 wt % to 3.0 wt % or from 0.01 wt % to 1.0 wt %. In any embodiment, such additives may be used in an amount from 0.01 to 5 wt %, such as from 0.01 to 1.5 wt %, based upon the weight of the lubricating composition.

In some embodiments, 3,4-oxypyridinone-containing compositions may contain substantially no (e.g., 0, or less than 0.001 wt %, 0.0005 wt % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

Compositions according to the present disclosure may contain an additive having a different enumerated function that also has secondary effects as a corrosion inhibitor (for example, Component B Functionalized olefinic polymer described above, may also have corrosion inhibitor effects). These additives are not included as corrosion inhibitors for purposes of determining the amount of corrosion inhibitor in a LOC or concentrate herein.

In any embodiment the LOC may include one or more antiwear agents that can reduce friction and excessive wear. Any antiwear agent known by a person of ordinary skill in the art may be used in the LOC. Non-limiting examples of suitable antiwear agents include zinc dithiophosphate, metal (e.g., Pb, Sb, Mo, and the like) salts of dithiophosphates, metal (e.g., Zn, Pb, Sb, Mo, and the like) salts of dithiocarbamates, metal (e.g., Zn, Pb, Sb, and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the antiwear agent May vary from 0.01 wt % to 5 wt %, from 0.05 wt % to 3 wt %, or from 0.1 wt % to 1 wt %, based on the total weight of the LOC.

In any embodiment, the antiwear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel, or copper. In some embodiments, the metal is zinc. In other embodiments, the alkyl group of the dihydrocarbyl dithiophosphate metal salt has from 3 to 22 carbon atoms, from 3 to 18 carbon atoms, from 3 to 12 carbon atoms, or from 3 to 8 carbon atoms. In further embodiments, the alkyl group is linear or branched.

Useful antiwear agents also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithio phosphate in which the metal constituent is zinc, or zinc dialkyl dithio phosphate (ZDDP) can be a useful component of the LOC of this disclosure. ZDDP can be derived from primary alcohols, secondary alcohols or mixtures thereof. Useful zinc dithiophosphates include secondary zinc dithiophosphates such as those available from The Lubrizol Corporation under the trade designations "LZ 677A", "LZ 1095" and "LZ 1371", from Chevron Oronite Company under the trade designation "OLOA 262" and from Afton Chemical under the trade designation "HiTEC™ 7169".

In any embodiment, the zinc compound can be a zinc dithiocarbamate complex wherein the nitrogen may be substituted by linear, cyclic, or branched, saturated or unsaturated, aliphatic hydrocarbon groups having from 1 to 10 carbon atoms. In any embodiment, the accompanying ligand is selected from the group consisting of water, hydroxide, ammonia, amino, amido, alkylthiolate, halide, and combinations thereof.

The antiwear additives, such as ZDDP and/or the zinc carbamates, are typically used in amounts of from 0.4 wt % to 1.2 wt %, such as from 0.5 wt % to 1.0 wt %, and such as from 0.6 wt % to 0.8 wt %, based on the total weight of the lubricating composition, although more or less can often be used advantageously. In an embodiment the antiwear additive is ZDDP, such as a secondary ZDDP, and is present in an amount of from 0.6 to 1.0 wt % of the total weight of the lubricating composition.

Antiwear additives useful herein also include boron-containing compounds, such as borate esters, borated fatty amines, borated epoxides, alkali metal (or mixed alkali metal or alkaline earth metal) borates and borated overbased metal salts.

Compositions according to the present disclosure may contain an additive having a different enumerated function that also has secondary effects as an antiwear agent (for example, Component B Functionalized olefinic polymer described above, may also have antiwear effects). These additives are not included as antiwear agents for purposes of determining the amount of antiwear agents in a LOC or concentrate herein.

In any embodiment the LOC may include a demulsifier additive. Demulsifiers useful herein include those described in U.S. Pat. No. 10,829,712 (col 20, In 34-40). Typically, a small amount of a demulsifying component may be used herein. A preferred demulsifying component is described in EP 330 522. It is obtained by reacting an alkylene oxide with an adduct obtained by reacting a bis-epoxide with a polyhydric alcohol. Such additives may be used in an amount of from 0.001 to 5 wt %, such as from 0.01 to 2 wt %.

Other optional additives include seal compatibility agents such as organic phosphates, aromatic esters, aromatic hydrocarbons, esters (butylbenzyl phthalate, for example), and polybutenyl succinic anhydride. Such additives may be used in an amount of from 0.001 to 5 wt %, such as from 0.01 to 2 wt %. In any embodiment, the seal compatibility agents are sea swell agents, such as PIBSA (polyisobutenyl succinic anhydride).

The LOC of the present disclosure can contain one or more extreme pressure agents that can prevent sliding metal surfaces from seizing under conditions of extreme pressure. Any extreme pressure agent known by a person of ordinary skill in the art may be used in the LOC. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally substituted dihydrocarbyl polysulfides, thia-aldehydes, thia-ketones, epithio compounds, sulfur-containing acetal derivatives, co-sulfurized blends of terpene and acyclic olefins, and poly sulfide olefin products, amine salts of phosphoric acid esters or thiophosphoric acid esters, and combinations thereof. The amount of the extreme pressure agent may vary from 0.01 wt % to 5 wt %, from 0.05 wt % to 3 wt %, or from 0.1 wt % to 1 wt %, based on the total weight of the LOC.

The LOC of the present disclosure can contain one or more unsaturated hydrocarbons. These unsaturated hydrocarbons are distinct from typical base stocks (base stocks of Group I, II, III, IV and/or V) and/or viscosity modifiers that may be present in the compositions and always have at least one (and typically only one, in the case of linear alpha-olefins, or LAOs) unsaturation per molecule. Without being bound by theory, the unsaturation(s) may provide an antioxidation functionality and/or a sulfur-trapping functionality that may supplement and/or replace one or more antioxidant additives and/or one or more corrosion inhibitor additives, but unsaturated hydrocarbons will typically not provide the only antioxidant nor the only corrosion inhibition functionality in lubrication oil compositions. Non-limiting examples of unsaturated hydrocarbons can include one or more unsaturated $C_{12}$-$C_{60}$ hydrocarbons (such as $C_{12}$-$C_{48}$ hydrocarbons, $C_{12}$-$C_{36}$ hydrocarbons, $C_{12}$-$C_{30}$ hydrocarbons, or $C_{12}$-$C_{24}$ hydrocarbons). When only one unsaturation is present, the unsaturated hydrocarbons may be termed linear alpha-olefins (LAOs). Other non-limiting examples of unsaturated hydrocarbons can include oligomers/polymers of polyisobutylenes that have retained (or been post-polymerization modified to exhibit) a (near-) terminal unsaturation, and/or blends thereof. When present, unsaturated hydrocarbons (LAOs) may be present from 0.01 to 5 wt % (such as from 0.1 to 3 mass %, such as from 0.1 to 1.5 mass %), based on total weight of the LOC.

When LOC contain one or more of the additives discussed above, the additive(s) are typically blended into the composition in an amount sufficient for it to perform its intended function. Typical amounts of such additives useful in the present disclosure, especially for use in crankcase lubricants, are shown in Table 1 below.

It is noted that many of the additives are shipped from the additive manufacturer as a concentrate, containing one or more additives together, with a certain amount of base stock or other diluents. Accordingly, the weight amounts in the Table 1 below, as well as other amounts mentioned herein, are directed to the amount of active ingredient (that is the non-diluent portion of the ingredient). The weight percent (mass %) indicated in Table 1 below is based on the total weight of the LOC.

TABLE 1

Exemplary Amounts of Optional Lubricating Oil Components

| Additive Formulations | A (mass %) | B (mass %) | C (mass %) |
|---|---|---|---|
| Dispersant (other than invention) | 0.1-20 | 0.1-20 | 1-8 |
| Detergents | 0.1-20 | 0.1-20 | 0.2-9 |
| Corrosion Inhibitor, Anti-rust / extreme pressure agents | 0-7 | 0.05-5 | 0.1-1.5 |
| Antioxidant | 0.01-10 | 0.1-5 | 0.1-4 |
| Pour Point Depressant | — | 0-5 | 0.01-1.5 |
| Anti-foaming Agent | — | 0-5 | 0.001-0.15 |
| Functionalized olefinic polymer | 0.01-10 | 0.1-5 | 0.1-2 |
| Friction Modifier | — | 1 | 0.5 |
| Antiwear Agent | 0.01-10 | 0.1-5 | 0.1-3 |
| Viscosity Modifier | — | 0.01-10 | 0.25-3 |
| Seal Swell Agents | — | 0-5 | 0-2 |
| Extreme Pressure Agents | — | 0-5 | 0-3 |
| Unsaturated Hydrocarbons (LAOs) | — | 0-5 | 0-3 |
| Base stock | Balance (such as 50 to 95%) | Balance | Balance |

The foregoing additives are typically commercially available materials. These additives may be added independently, but are usually pre-combined in packages, which can be obtained from suppliers of LOC additives. Additive packages with a variety of ingredients, proportions and characteristics are available and selection of the appropriate package will take the use of the ultimate composition into account.

This disclosure also relates to a method of lubricating an automotive internal combustion engine during operation of the engine comprising:

(i) providing to a crankcase of the automotive internal combustion engine an automotive crankcase the lubricating composition of described herein;

(ii) providing a hydrocarbon fuel in the automotive internal combustion engine; and (iii) combusting the fuel in the automotive internal combustion engine, such as a spark-ignited or compression-ignited two- or four-stroke reciprocating engines such as a diesel engine or passenger car engine (such as a spark-ignited combustion engine).

This disclosure also relates to a fuel composition comprising the LOCs described herein and a hydrocarbon fuel, wherein the fuel may be derived from petroleum and/or biological sources ("biofuel" or "renewable fuel"). In any embodiment, the fuel comprises from 0.1 to 100 mass % renewable fuel, such as from 1 to 75 mass % renewable fuel, such as from 5 to 50 mass % renewable fuel, based upon the total mass of the from 1 to 50 mass % renewable fuel and the petroleum derived fuel.

The renewable fuel component is typically produced from vegetable oil (such as palm oil, rapeseed oil, soybean oil, jatropha oil), microbial oil (such as algae oil), animal fats (such as cooking oil, animal fat, and/or fish fat) and/or biogas. Renewable fuel refers to biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges, which provide the desired properties to the component, depending on the intended use.

Uses

The LOC of the disclosure may be used to lubricate mechanical engine components, particularly in internal combustion engines, e.g., spark-ignited, or compression-ignited, two- or four-stroke reciprocating engines, by adding the lubricant thereto. Typically, they are crankcase lubricants, such as passenger car motor oils or heavy-duty diesel engine lubricants.

In any embodiment the LOC of the present disclosure are suitably used in the lubrication of the crankcase of a compression-ignited, internal combustion engine, such as a heavy-duty diesel engine.

In any embodiment the LOC of the present disclosure are suitably used in the lubrication of the crankcase of a spark-ignited turbo charged internal combustion engine.

In any embodiment, the LOC of this disclosure are used in spark-assisted high compression internal combustion engines and, when used in high compression spark ignition internal combustion engines the LOC of this disclosure are useful in lubricating high compression spark ignition engines.

In any embodiment, the LOC of the present disclosure are suitably used in the lubrication of the crankcase of an engine for a heavy-duty diesel vehicle (i.e., a heavy-duty diesel vehicle having a gross vehicle weight rating of 10,000 pounds or more).

In any embodiment, the LOC of the present disclosure are suitably used in the lubrication of the crankcase of a passenger car diesel engine.

In any embodiment, lubricating oil formulations of this disclosure are particularly useful in compression-ignited internal combustion engines, i.e., heavy-duty diesel engines, employing low viscosity oils, such as API FA-4 and future oil categories, in which wear protection of the valve train becomes challenging.

Having described the functionalized olefinic polymer in its various potential embodiments, described herein numbered embodiments is:

P1. A functionalized olefinic polymer comprising an olefinic polymer bound to at least one fused-ring polycyclic amine for each polymer molecule, wherein the fused-ring polycyclic amine comprises at least one secondary amine and at least one other heteroatom therein and further comprises at least one primary amine directly pendant thereto, wherein the at least one fused-ring polycyclic amine is bound to the olefinic polymer through the at least the one primary amine.

P2. The functionalized olefinic polymer of paragraph 1, wherein pendant amine groups comprising an alkyl-linking group or chain between the primary amine and fused-ring polycyclic amine are absent.

P3. The functionalized olefinic polymer of paragraphs 1 or 2, wherein the fused-ring polycyclic amine comprises a secondary amine bridging group joining at least two aromatic rings and at least one other heteroatom within the ring structure.

P4. The functionalized olefinic polymer of any one of the previous numbered paragraphs, wherein the fused-ring polycyclic amine comprises aromatic rings selected from the group consisting of benzene, naphthalene, anthracene, phenanthrene, pyrene, and combinations thereof, and phenyl- and alkyl-substituted versions thereof.

P5. The functionalized olefinic polymer of any one of the previous numbered paragraphs, wherein the fused-ring polycyclic amine is a tricyclic aromatic amine comprising two aromatic rings bridged by a nitrogen atom as a first bridge, and a second bridge comprising a heteroatom radical selected from the group consisting of —O—, —NH—, —Se—, —S—, —SO—, and —$SO_2$—.

P6. The functionalized olefinic polymer of any one of the previous numbered paragraphs, wherein the fused-ring polycyclic amine can be described with reference to the structure:

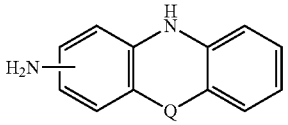

wherein Q is a heteroatom radical selected from the group consisting of —O—, —NH—, —Se—, —S—, —SO—, and —$SO_2$—.

P7. The functionalized olefinic polymer of any one of the previous numbered paragraphs, wherein the fused-ring polycyclic amine is selected from the group consisting of 3-aminophenothiazine, 3-amino-10H-phenoxazine, 3-aminophenoxathiine, 3-aminophenothiazine-5-oxide, 3-aminophenothiazine-5,5-dioxide, 3,7-diamino-10H-phenothiazine, and combinations thereof.

P8. The functionalized olefinic polymer of any one of the previous numbered paragraphs, additionally comprising partially functionalizing the olefinic polymer with ethyleneamine and/or oligomers of ethyleneamine.

P9. The functionalized olefinic polymer of any one of the previous numbered paragraphs, wherein the olefinic polymer is selected from the group consisting of polyisobutylene; ethylene-propylene copolymer; hydrogenated polyisoprene polymer; and polybutadiene polymer; and copolymers thereof.

P10. The functionalized olefinic polymer of any one of the previous numbered paragraphs, having a viscosity (in Gp. II base stock, 9.0 wt % carbon black) at a shear rate of 2.1 $s^{-1}$ (±0.1) of less than 12 Pa-s.

P11. The functionalized olefinic polymer of any one of the previous numbered paragraphs, wherein the polymer is partially or fully hydrogenated prior to functionalization.

P12. The functionalized olefinic polymer of any one of the previous numbered paragraphs, having an Mw/Mn (GPC-PS) within a range from 1 to 4.

P13. The functionalized olefinic polymer of any one of the previous numbered paragraphs, having an Mn within a range from 500 g/mole to 100,000 g/mol (GPC-PS).

P14. The functionalized olefinic polymer of any one of the previous numbered paragraphs, having a Functionality Value (Fv), representing the average number of fused-ring polycyclic amines per polymer chain, of 12 or less.

P15. The functionalized olefinic polymer of any one of the previous numbered paragraphs, wherein the functionalized olefinic polymer is obtained by reacting fully or partially hydrogenated polymer with an acylating agent and thereafter reacting the acylated polymer with the fused-ring polycyclic amine to form the functionalized olefinic polymer.

P16. The functionalized olefinic polymer of numbered paragraph 15, wherein the acylating agent is succinic anhydride.

P17. The functionalized olefinic polymer of numbered paragraphs 16 or 17, having a Functionality Value (Fv), representing the average number of succinic anhydride groups per polymer chain, of 12 or less.

P18. The functionalized olefinic polymer of any one of numbered paragraphs 15-17, wherein the olefinic polymer has an Mn within a range from 500 g/mole to 100,000 g/mol (GPC-PS).

P19. The functionalized olefinic polymer of any one of numbered paragraphs 15-18, wherein the reaction is a thermal maleation process.

P20. The functionalized olefinic polymer of numbered paragraphs 15-19, wherein the polymer is polyisobutylene.

P21. A LOC comprising or resulting from the admixing of at least 50 mass % of one or more base stocks, based upon the weight of the LOC; and one or more functionalized olefinic polymers of any one of the previous numbered paragraphs.

P22. The LOC of numbered paragraph 21, further comprising one or more additional additives selected from the group consisting of dispersants; detergents; friction modifiers; antioxidants; pour point depressants; anti-foam agents; viscosity modifiers; inhibitors and/or anti-rust agents; and antiwear agents.

P23. A concentrate comprising or resulting from the admixing of from 1 to less than 50 mass % of one or more base stocks; and from 0.10 to 20 mass %, based upon the weight of the concentrate, of one or more of the functionalized olefinic polymers of any one of the previous numbered paragraphs, based upon the weight of the concentrate.

The following non-limiting examples are provided to illustrate the disclosure.

EXAMPLES

All reactions are performed in appropriately sized glass reactors, equipped with overhead stirring, and run under an inert atmosphere (e.g., $N_2$). Also, all reactions, unless stated otherwise, were carried out with on a scale involving 50-500 grams total of the starting maleated polymer (normalizing to 1.0 molar equivalents of anhydride), and the remaining reagents scaled appropriately based on the molar equivalents described below. Unless otherwise specified, all "equivalents" (eq.) listed represent molar equivalents of primary amine vs. the total moles of the anhydride functional groups present in the reaction mixture (regardless of the number of anhydrides on each polymer chain).

A mixture of polyamine oligomers Ethyleneamine E 100 (polyamine, PAM, generally "ethyleneamine") was sourced from Huntsman International LLC. Ethyleneamine E 100 are polyethylene polyamines, a mixture of tetraethylenepentamine (TEPA), pentaethylenehexamine (PEHA), hexaethyleneheptamine (HEHA), and higher molecular weight products. E-100 is a complex mixture of various linear, cyclic, and branched products with a number-average molecular weight of 250-300 g/mole. Mass charges and molar equivalents of Ethyleneamine E 100 were calculated on the basis of primary amine content in the amine mixture; its MW was approximated to be 115.2 g/mol of primary amine.

Maleated ethylene-propylene copolymer (EP-SA) and maleated hydrogenated polyisoprene (HPIP-SA) samples were produced according to methods similar to those described in U.S. Ser. No. 63/379,006, filed Oct. 11, 2023.

The "effective MW" (MW per mol of anhydride) of the PIBSA samples is calculated according to (3):

$$MW = \frac{112.2}{SAP} * 1000, \tag{3}$$

where, SAP=the saponification number of the sample, in $mg_{KOH}/g_{sample}$, according to ASTM D94.

The functionality (Fv), representing the average number of anhydride groups per polymer chain, is calculated according to (4):

$$Fv = \frac{Mn_{poly} * SAP}{(1122 * AI\ \% * 100) - (98 * SAP)}, \tag{4}$$

where, $Mn_{poly}$=the number average molecular weight of the polymer (vs. PS standard); SAP=the saponification number of the sample, in $mg_{KOH}/g_{sample}$, according to ASTM D94; and AI %=the wt. percent of active material (e.g. PIBSA or amine) in the sample (excludes unfunctionalized polymer and diluent), expressed as a decimal.

The functionality of functionalized EP and HPIP polymers was measured based on the N-phenyl-p-phenylene diamine polymers according to methods similar to those described in U.S. Ser. No. 63/379,006, filed Oct. 11, 2023.

The coupling ratio (CR) is calculated according to (5):

$$CR = \frac{n_{anhydride}}{n_{amine}}, \tag{5}$$

where, $n_{anhydride}$=moles of anhydride in the reaction, calculated from the effective MW (above); and $n_{amine}$=moles of primary amine in the reaction.

The wt % of active ingredient in the product (% $AI_{prod}$) is calculated according to:

$$\%\ AI_{prod} = \frac{(m_{poly} * \%\ AI) + m_{amine} - (n_{limiting} * 18)}{m_{total} - (n_{limiting} * 18)}, \tag{6}$$

where, $m_{poly}$=the total mass of PIBSA added to the reaction, g; AI %=the wt. percent of active material (e.g. PIBSA) in the sample (excludes unfunctionalized PIB and diluent), expressed as a decimal, measured on the maleated polymer starting material; $m_{amine}$=the total mass of amine reagent(s) added to the reaction, g; $m_{total}$=the total mass of all materials (i.e. reagents and diluents) added to the reaction, g; and $n_{limiting}$=moles of the limiting reagent in the reaction (either anhydride or amine, whichever is lower). Assuming a complete reaction, this will be equal to the moles of water (byproduct from the condensation) volatilized out of the reaction mixture at high temperature.

HPLC analysis of Comparative Example 8 was carried out on a Shimadzu LCMS 2010, equipped with a DGU-20A3 degasser, CTO-20A Column oven, LC-20AB Binary pump, SPD-M20A PDA (Photo Diode array) detector, and 1020EV single quad mass spectrometer using LCMS Solutions software (release 3.40), under the following conditions in Table 2:

TABLE 2

Conditions for HPLC Analysis

| | |
|---|---|
| Mobile phase A | 10 mM Ammonium acetate in 1 L LC-MS water |
| Mobile phase B | 10 mM Ammonium acetate in 1 L LC-MS Methanol |
| Oven temperature | 40° C. |
| Detector temperature | 40° C. |
| Detector | PDA, 245 nm |
| Column | Agilent Zorbax ™ C18<br>4.6 mm * 150 mm * 5.0 μm |
| Flow rate | 1.5 mL/min |
| Sample Injection vol | 5 μL |

| Solvent Gradient | Time | % A | % B |
|---|---|---|---|
| Start | 0 | 50 | 50 |
| | 15 | 0 | 10 |
| | 35 | 0 | 100 |
| End | 35.1 | 50 | 50 |
| Post run column flush | 50% Water and 50% Methanol | | |

Sooted rheology experiments were carried out on a Haake RS600 Rheometer, controlled by Haake RheoWin Job Manager software (ver. 4.30.0028), using the following conditions in Table 3:

TABLE 3

| Sooted Rheology Methods | | | | | |
|---|---|---|---|---|---|
| Measuring Geometry | Z20 DIN | | | | |
| Gap | 4.2 mm | | | | |
| Volume | 8.2 mL | | | | |
| Temp. | 100° C. | | | | |
| Shear Profile | Type | Shear ($s^{-1}$) | Time(s) | # Data | Settings |
| Start | Rotation | 10.0 | 30 | 2 | Acquisition: logarithmic |
| | Recover | 0 | 600 | 11 | Acquisition: Linear |
| | Rot. Ramp | 1.0 → 1000.0 | 480 | 100 | Parameters: linear, continuous Acquisition: logarithmic |
| | Rot. Ramp | 1000.0 → 1.0 | 480 | 100 | Parameters: linear, continuous Acquisition: logarithmic |
| End | Rot. Ramp | 1.0 → 1000.0 | 480 | 300 | Parameters: linear, continuous Acquisition: logarithmic |

The dynamic viscosity of the sample on the final shear sweep was used to compare the soot dispersancy of the different components. Viscosities (n, Pa-s) were taken at approximate shear rates of 2.1, 4.1 and 8.1 (l/s, ±0.1) as stated in the Tables 5 and 7 below.

All measured quantities (weights, temperatures) are to within ±1%.

Example 1

1214 g PIBSA (Mn 1300 g/mol, SAP 112 $mg_{KOH}$/g, 76.0% active material) was charged into an appropriately sized reaction vessel with stirring, and heated to 160° C. Once the target temperature was reached, 245 g of 3-aminophenothiazine (0.98 molar eq. vs. total moles of anhydride) was added portion wise over 10-30 min. The addition was frequently paused to allow the foaming from the water vapor (byproduct) to subside before addition was resumed.

After the addition was completed, the reaction temperature was maintained at 160° C. for a further 3 h before the mixture was diluted with 960 g of AMEXOM 100 (Gp. I base oil) to target the specific % of active material in the solution below. The reaction was mixed thoroughly for 10 min, and allowed to cool to room temperature. The olefinic polymer (polyisobutylene, PIB) and finished functionalized olefinic polymer was determined to have the features summarized in Table 4.

The functionalized olefinic polymer viscosity was tested. 200-500 g of a solution containing 1.8 wt % of the active ingredient in aramcoPRIMA 220 (Gp. II base oil) was prepared by mixing appropriate amounts of the finished component and aramcoPRIMA 220 in a beaker equipped with overhead stirring. The mixture was heated to 75° C. for between 1-3 h, until the component was fully dissolved.

A suspension of 9.0 wt % carbon black (Vulcan XC72R) in the dispersant solution was prepared by weighing 45.5 g of the 1.8 wt % AI solution added it to a 100 ml beaker containing 4.5 g of Vulcan XC72R carbon black. The suspension was mixed via overhead stirring (200-400 rpm) at 90° C. for 16 h, followed by 100° C. for 1 h under an air atmosphere.

The dynamic viscosity of the suspension was measured on a Haake rheometer according to the above method. Selected viscosities and shear rates (2.15, 4.10, 8.10 l/s) of the sample are summarized in Table 5. Shear rate and viscosity data for Example 1 are also plotted in FIG. 1 relative to Comparative Examples 1, 3 and 4.

Example 2

The reaction was run according to the procedure for Example 1, except that the PIBSA above was substituted for PIBSA (Mn 1300, SAP 118 $mg_{KOH}$/g, 85.9% active material). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.18, 4.04, 8.10 l/s) of the sample are summarized in Table 5.

Example 3

The reaction was run according to the procedure for Example 1, except that the PIBSA above was substituted for PIBSA (Mn 1300, SAP 96 $mg_{KOH}$/g, 88.8% active material), and 1.0 molar eq. of 3-aminophenothiazine (vs. total moles of anhydride) was added. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.17, 4.02, 8.20 l/s) of the sample are summarized in Table 5.

Example 4

The reaction was run according to the procedure for Example 1, except that the PIBSA above was substituted for PIBSA (Mn 1300, SAP 60 $mg_{KOH}$/g, 65.0% active material). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.05, 4.20, 8.20 l/s) of the sample are summarized in Table 5.

Example 5

The reaction was run according to the procedure for Example 1, except that the PIBSA above was substituted for PIBSA (Mn 2300, SAP 69 $mg_{KOH}/g$, 84.0% active material), and 1.0 molar eq. of 3-aminophenothiazine (vs. total moles of anhydride) was added. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.17, 4.01, 8.10 l/s) of the sample are summarized in Table 5.

Example 6

The reaction was run according to the procedure for Example 1, except that the PIBSA above was substituted for PIBSA (Mn 2300, SAP 55 $mg_{KOH}/g$, 85.0% active material). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.13, 4.14, 8.10 l/s) of the sample are summarized in Table 5.

Example 7

The reaction was run according to the procedure for Example 1, except that the PIBSA above was substituted for PIBSA (Mn 1000, SAP 169 $mg_{KOH}/g$, 89.0% active material. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.22, 4.08, 8.10 l/s) of the sample are summarized in Table 5.

Example 8

The reaction was run according to the procedure for Example 1, except that the PIBSA above was substituted for PIBSA (Mn 1000, SAP 110 $mg_{KOH}/g$, 84.5% active material), and 1.0 molar eq. of 3-aminophenothiazine (vs. total moles of anhydride) was added. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.21, 4.14, 8.0 l/s) of the sample are summarized in Table 5.

Example 9

The reaction was run according to the procedure for Example 1, except that the PIBSA above was substituted for a chloro-PIBSA (Mn 950, SAP 89 $mg_{KOH}/g$, 72.0% active material). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.06, 4.19, 8.10 l/s) of the sample are summarized in Table 5.

Example 10

The reaction was run according to the procedure for Example 1, except that the PIBSA above was substituted for a chloro-PIBSA (Mn 2225, SAP 46 $mg_{KOH}/g$, 74.0% active material). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.10, 4.07, 8.20 l/s) of the sample are summarized in Table 5.

Example 11

The reaction was run according to the procedure for Example 1, except that 1.5 molar equivalents of 3-aminophenothiazine (vs. total moles of anhydride) were added to the reaction instead. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.22, 4.17, 8.0 l/s) of the sample are summarized in Table 5.

Example 12

The reaction was run according to the procedure for Example 1, except that 1.05 molar equivalents of 3-aminophenothiazine (vs. total moles of anhydride) were added to the reaction instead. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.13, 4.03, 8.2 l/s) of the sample are summarized in Table 5.

Example 13

The reaction was run according to the procedure for Example 1, except that 0.95 molar equivalents of 3-aminophenothiazine (vs. total moles of anhydride) were added to the reaction instead. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.18, 4.17, 8.10 l/s) of the sample are summarized in Table 5.

Example 14

The reaction was run according to the procedure for Example 1, except that 0.75 molar equivalents of 3-aminophenothiazine (vs. total moles of anhydride) were added to the reaction instead. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.09, 4.01, 8.10 l/s) of the sample are summarized in Table 5.

Example 15

The reaction was run according to the procedure for Example 1, except that 0.51 molar equivalents of 3-aminophenothiazine (vs. total moles of anhydride) were added to the reaction instead. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.10, 4.12, 8.2 l/s) of the sample are summarized in Table 5.

Example 16

The reaction was run according to the procedure for Example 1, except that 1.0 molar eq. of 3-amino-10H-phenoxazine (vs. total moles of anhydride) was added to the reaction instead of 3-aminophenothiazine, and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.02, 4.14, 8.0 l/s) of the sample are summarized in Table 5.

Example 17

The reaction was run according to the procedure for Example 1, except that 1.0 molar eq. of 3-aminophenoxathiine (vs. total moles of anhydride) was added to the reaction instead of 3-aminophenothiazine, and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.17, 4.10, 8.20 l/s) of the sample are summarized in Table 5.

Example 18

The reaction was run according to the procedure for Example 1, except that 1.0 molar eq. of 3-aminophenothiazine-5-oxide (vs. total moles of anhydride) was added to the reaction instead of 3-aminophenothiazine, and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.03, 4.01, 8.10 l/s) of the sample are summarized in Table 5.

Example 19

The reaction was run according to the procedure for Example 1, except that 1.0 molar eq. of 3-aminophenothiazine-5,5-dioxide (vs. total moles of anhydride) was added to the reaction instead of 3-aminophenothiazine, and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.22, 4.11, 8.10 l/s) of the sample are summarized in Table 5.

Example 20

The reaction was run according to the procedure for Example 1, except that a charge of 0.56 molar eq. of 3-aminophenothiazine, followed by a charge 0.44 molar eq. of 3,7-diamino-10H-phenothiazine (primary amine vs. total moles of anhydride) was used instead of the full charge of 3-aminophenothiazine and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.03, 4.04, 8.20 l/s) of the sample are summarized in Table 5.

Example 21

The reaction was run according to the procedure for Example 1, except that a charge of 0.26 molar eq. of 3-aminophenothiazine, followed by a charge 0.74 molar eq. of 3,7-diamino-10H-phenothiazine (primary amine vs. total moles of anhydride) was used instead of the full charge of 3-aminophenothiazine and the reaction was diluted with Gp. II base oil (to target the specific % of active material in the solution below). The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.09, 4.10, 8.20 l/s) of the sample are summarized in Table 5.

Example 22

The reaction was run according to the procedure for Example 7, except that a charge of 0.49 molar eq. of 3-aminophenothiazine, followed by a charge 0.49 molar eq. of Ethyleneamine E 100 (primary amine vs. total moles of anhydride) was used instead of the full charge of 3-aminophenothiazine. The sample was not diluted at the end of the reaction. The olefinic polymer (polyisobutylene, PIB) and finished functionalized olefinic polymer was determined to have the features summarized in Table 4.

The dynamic viscosity of the suspension was measured on a Haake rheometer according to the above method. Selected viscosities and shear rates (2.00, 4.08, 8.10 l/s) of the sample are summarized in Table 5.

Example 23

The reaction was run according to the procedure for Example 1, except that the PIBSA was substituted for a maleated ethylene-propylene copolymer (EP), and the reaction was diluted with Gp. II base oil (to target the specific % of active material in the solution below). The olefinic polymer (EP) and finished functionalized olefinic polymer was determined to have the features summarized in Table 4.

The dynamic viscosity of the suspension was measured on a Haake rheometer according to the above method, except that the functional polymer was tested at 1.2% active material. Selected viscosities and shear rates (2.19, 4.07, 8.13 l/s) of the sample are summarized in Table 5.

Example 24

The reaction was run according to the procedure for Example 1, except that the PIBSA was substituted for a maleated hydrogenated-polyisoprene copolymer (HPIP), and the reaction was diluted with Gp. II base oil (to target the specific % of active material in the solution below). The olefinic polymer (HPIP) and finished functionalized olefinic polymer was determined to have the features summarized in Table 4.

The dynamic viscosity of the suspension was measured on a Haake rheometer according to the above method, except that the functional polymer was tested at 1.2% active material. Selected viscosities and shear rates (2.20, 4.07, 8.12 l/s) of the sample are summarized in Table 5.

TABLE 4

Measured Values of Mn, Fv, CR and % AI for Each Example

| Ex. | Amine | Polymer | Mn | Fv | CR | % $AI_{prod}$ |
|---|---|---|---|---|---|---|
| 1 | 3-Aminophenothiazine | PIB | 1300 | 2.0 | 1.02 | 48% |
| 2 | 3-Aminophenothiazine | PIB | 1300 | 1.8 | 1.02 | 40% |
| 3 | 3-Aminophenothiazine | PIB | 1300 | 1.4 | 1.0 | 66% |
| 4 | 3-Aminophenothiazine | PIB | 1300 | 1.15 | 1.02 | 50% |
| 5 | 3-Aminophenothiazine | PIB | 2300 | 1.8 | 1.0 | 65% |
| 6 | 3-Aminophenothiazine | PIB | 2300 | 1.4 | 1.02 | 40% |
| 7 | 3-Aminophenothiazine | PIB | 1000 | 1.9 | 1.02 | 40% |
| 8 | 3-Aminophenothiazine | PIB | 1000 | 1.3 | 1.0 | 62.6% |
| 9 | 3-Aminophenothiazine | PIB | 950 | 1.2 | 1.02 | 50% |
| 10 | 3-Aminophenothiazine | PIB | 2225 | 1.3 | 1.02 | 50% |
| 11 | 3-Aminophenothiazine | PIB | 1300 | 2.0 | 0.65 | 64% |
| 12 | 3-Aminophenothiazine | PIB | 1300 | 2.0 | 0.95 | 65% |
| 13 | 3-Aminophenothiazine | PIB | 1300 | 2.0 | 1.05 | 67% |
| 14 | 3-Aminophenothiazine | PIB | 1300 | 2.0 | 1.34 | 66% |
| 15 | 3-Aminophenothiazine | PIB | 1300 | 2.0 | 1.95 | 59% |
| 16 | 3-Amino-10H-phenoxazine | PIB | 1300 | 2.0 | 1.0 | 40% |
| 17 | 3-Aminophenoxathiine | PIB | 1300 | 2.0 | 1.0 | 40% |
| 18 | 3-Aminophenothiazine-5-oxide | PIB | 1300 | 2.0 | 1.0 | 40% |
| 19 | 3-Aminophenothiazine-5,5-dioxide | PIB | 1300 | 2.0 | 1.0 | 40% |
| 20 | 3-Aminophenothiazine/3,7-diamino-10H-phenothiazine (1.25:1) | PIB | 1300 | 2.0 | 1.0 | 40% |
| 21 | 3-Aminophenothiazine/3,7-diamino-10H-phenothiazine (1.25:1) | PIB | 1300 | 2.0 | 1.0 | 40% |
| 22 | 3-Aminophenothiazine/E-100 and Ethyleneamine | PIB | 1000 | 1.9 | 1.02 | 90% |
| 23 | 3-Aminophenothiazine | EP | 23k | 4.7 | 1.0 | 38% |
| 24 | 3-Aminophenothiazine | HPIP | 40k | 7.9 | 1.0 | 39% |

TABLE 5

Measured Viscosity Values (Pa-s) at Three Shear Rates (1/s) of Each Example

| Ex. | η (Pa-s) at shear rate at 2.1 (1/s) | η (Pa-s) at shear rate at 4.1 (1/s) | η (Pa-s) at shear rate at 8.1 (1/s) |
|---|---|---|---|
| 1 | 3.66 | 1.99 | 1.04 |
| 2 | 4.28 | 2.37 | 1.19 |
| 3 | 8.10 | 4.33 | 2.08 |
| 4 | 23.09 | 15.68 | 9.56 |
| 5 | 11.33 | 8.30 | 3.85 |
| 6 | 17.23 | 12.05 | 6.07 |
| 7 | 3.68 | 2.08 | 1.10 |
| 8 | 7.04 | 3.67 | 1.86 |
| 9 | 22.98 | 15.26 | 8.47 |
| 10 | 11.20 | 7.73 | 3.93 |
| 11 | 5.10 | 2.77 | 1.46 |
| 12 | 3.07 | 1.65 | 0.87 |
| 13 | 2.06 | 1.39 | 0.76 |
| 14 | 5.11 | 2.69 | 1.35 |
| 15 | 7.78 | 3.87 | 1.91 |
| 16 | 3.74 | 1.85 | 1.00 |
| 17 | 16.95 | 12.28 | 6.93 |
| 18 | 0.25 | 0.26 | 0.22 |
| 19 | 0.00 | 0.02 | 0.02 |
| 20 | 4.05 | 2.08 | 1.05 |
| 21 | 10.56 | 6.01 | 2.99 |
| 22 | 7.89 | 3.80 | 1.87 |
| 23 | 4.39 | 2.50 | 1.28 |
| 24 | 2.03 | 1.33 | 0.69 |

Comparative Example 1

A comparative experiment was run with unfunctionalized polyisobutylene. The olefinic polymer (polyisobutylene, PIB) was determined to have the features summarized in Table 7.

The dynamic viscosity of the suspension was measured on a Haake rheometer according to the above method. Selected viscosities and shear rates (2.00, 4.03, 8.1 l/s) of the sample are summarized in Table 8.

Shear rate and viscosity data for Comparative Example 1 is also plotted in FIG. 1 relative to Example 1 and Comparative Examples 3 and 4.

Comparative Example 2

A comparative experiment was run with PIBSA (Mn 1300 g/mol, SAP 112 $mg_{KOH}$/g, 76.0% active material). The olefinic polymer (polyisobutylene, PIB) was determined to have the features summarized in Table 7.

The dynamic viscosity of the suspension was measured on a Haake rheometer according to the above method. Selected viscosities and shear rates (2.08, 4.11, 8.0 l/s) of the sample are summarized in Table 8.

Comparative Example 3

The reaction was run according to the procedure for Example 1, except that 0.98 molar equivalents of N-phenyl-p-phenylenediamine (vs. total moles of anhydride) were added to the reaction instead of 3-aminophenothiazine. The olefinic polymer (PIB) and modified polymer were determined to have the features summarized in Table 7.

The dynamic viscosity of the suspension was measured on a Haake rheometer according to the above method. Selected viscosities and shear rates (2.12, 4.12, 8.0 l/s) of the sample are summarized in Table 8.

Shear rate and viscosity data for Comparative Example 3 are also plotted in FIG. 1 relative to Example 1 and Comparative Examples 1 and 4.

Comparative Example 4

The reaction was run according to the procedure for Example 1, except that 1.0 molar eq. of 3-amino-9H-carbazole (vs. total moles of anhydride) was added to the reaction instead of 3-aminophenothiazine, and the reaction was diluted with Gp. II base oil (to target the specific % of active material in the solution below). The olefinic polymer (PIB) and modified polymer were determined to have the features summarized in Table 7.

The dynamic viscosity of the suspension was measured on a Haake rheometer according to the above method. Selected viscosities and shear rates (2.15, 4.03, 8.1 l/s) of the sample are summarized in Table 8.

Shear rate and viscosity data for Comparative Example 4 are also plotted in FIG. 1 relative to Example 1 and Comparative Examples 1 and 3.

Comparative Example 5

The reaction was run according to the procedure for Example 1, except that 1.0 molar equivalents of 3-(10H-phenothiazin-3-yl) propan-1-amine (vs. total moles of anhydride) were added to the reaction instead of 3-aminophenothiazine, and the reaction was diluted with Gp. II base oil (to target the specific % of active material in the solution below). The olefinic polymer (PIB) and modified polymer were determined to have the features summarized in Table 7.

The dynamic viscosity of the suspension was measured on a Haake rheometer according to the above method. Selected viscosities and shear rates (2.19, 4.14, 8.0 l/s) of the sample are summarized in Table 8.

Comparative Example 6

The reaction was run according to the procedure for Example 1, except that 1.0 molar eq. of 2-(10H-phenothiazin-10-yl) ethan-1-amine (vs. total moles of anhydride) was added to the reaction instead of 3-aminophenothiazine, and the reaction was diluted with Gp. II base oil (to target the specific % of active material in the solution below). The olefinic polymer (PIB) and modified polymer were determined to have the features summarized in Table 7.

The dynamic viscosity of the suspension was measured on a Haake rheometer according to the above method. Selected viscosities and shear rates (2.02, 4.16, 8.1 l/s) of the sample are summarized in Table 8.

Comparative Example 7

The reaction was run according to the procedure for Example 7, except that a charge of 0.49 molar eq. of 2-ethyl-1-hexylamine, followed by a charge 0.49 molar eq. of Ethyleneamine E 100 (primary amine vs. total moles of anhydride) was used instead of the full charge of 3-aminophenothiazine. The olefinic polymer (PIB) and modified polymer were determined to have the features summarized in Table 7.

The dynamic viscosity of the suspension was measured on a Haake rheometer according to the above method. Selected viscosities and shear rates (2.16, 4.19, 8.1 l/s) of the sample are summarized in Table 8.

Comparative Example 8

200 g Montmorillonite K10 clay was dried on rotary evaporator at 100° C. The vacuum was gradually reduced from 200 mbar down to 50 mbar, to avoid disturbing the powder in the flask. The clay was held at 100° C. for 1 hour, before being removed from the heat but kept under vacuum to cool.

Into a nitrogen-filled 1 L reactor was charged 280 g of 4,6-dimethylhept-1-ene (2.2 mol, 4.4. molar eq.) and 100 g of phenothiazine (0.5 mol, normalized to 1.0 molar eq.). Stirring was set to 300-400 rpm to suspend the solids, followed by charging 20 g of dried Montmorillonite K10 clay into the reactor.

The reaction mixture was then heated to 138° C. for over 2 h (approx. 1° C./min), and held at temperature for 42 h, before being allowed to cool to ambient temperature.

The reaction mixture was diluted with 200 g of heptane and filtered through a pad of 18 g celite to remove the clay catalyst. The pad was washed with 3×50 ml portions of heptane to remove residual material. Volatiles were removed on a rotary evaporator (ramping from 70° C. to 120° C., and maintaining that temperature until a constant mass was obtained), yielding 216 g of a brown oil.

The mixture was determined by HPLC analysis (UV 245 nm, area %) to contain the features in Table 6:

TABLE 6

HPLC Analysis of Comparative Clay Example 8

| Component | Total (area %) |
|---|---|
| Phenothiazine | 0.3% |
| mono-nonyl phenothiazine | 13.1% |
| di-nonyl phenothiazine | 82.7% |
| tri-nonyl phenothiazine | 3.9% |

For the purpose of the viscosity measurements, the mixture was considered to be 100% AI. A solution of 1.8 wt % of the component was prepared according to the procedure for the dilute solution in Example 1.

The dynamic viscosity of the suspension was measured on a Haake rheometer according to the above method. Selected viscosities and shear rates (2.15, 4.03, 8.0 l/s) of the sample are summarized in Table 8.

Comparative Example 9

A comparative experiment was run with unfunctionalized hydrogenated-polyisoprene. The olefinic polymer (HPIP) and modified polymer were determined to have the features summarized in Table 7.

The dynamic viscosity of the suspension was measured on a Haake rheometer according to the above method, except that the functional polymer was tested at 1.2% active material. Selected viscosities and shear rates (2.01, 4.10, 8.20 l/s) of the sample are summarized in Table 8.

Comparative Example 10

The reaction was run according to the procedure for Example 1, except that the PIBSA was substituted for a maleated ethylene-propylene copolymer, 1.0 molar eq. of N-phenyl-p-phenylenediamine (vs. total moles of anhydride) was added to the reaction instead of 3-aminophenothiazine, and the reaction was diluted with Gp. II base oil (to target the specific % of active material in the solution below). The olefinic polymer (PIB) and modified polymer were determined to have the features summarized in Table 7.

The dynamic viscosity of the suspension was measured on a Haake rheometer according to the above method, except that the functional polymer was tested at 1.2% active material. Selected viscosities and shear rates (2.19, 4.01, 8.16 l/s) of the sample are summarized in Table 8.

Comparative Example 11

The reaction was run according to the procedure for Example 1, except that the PIBSA was substituted for a maleated hydrogenated-polyisoprene copolymer, 1.0 molar eq. of N-phenyl-p-phenylenediamine (vs. total moles of anhydride) was added to the reaction instead of 3-aminophenothiazine, and the reaction was diluted with Gp. II base oil (to target the specific % of active material in the solution below). The olefinic polymer (PIB) and modified polymer were determined to have the features summarized in Table 7.

The dynamic viscosity of the suspension was measured on a Haake rheometer according to the above method, except that the functional polymer was tested at 1.2% active material. Selected viscosities and shear rates (2.18, 4.07, 8.09 l/s) of the sample are summarized in Table 8.

TABLE 7

Measured Values of Mn, Fv, CR and % AI for Each Comparative Examples

| C. Ex. | Amine | polymer | Mn | Fv | CR | % $AI_{prod}$ |
|---|---|---|---|---|---|---|
| C1 | N/A | PIB | 1300 | 0 | N/A | N/A |
| C2 | succinic anhydride modified | PIB | 1300 | 2.0 | N/A | 76% |
| C3 | N-phenyl-p-phenylenediamine | PIB | 1300 | 2.0 | 1.02 | 50% |
| C4 | 3-Amino-9H-carbazole | PIB | 1300 | 2.0 | 1.0 | 40% |
| C5 | 3-(10H-phenothiazin-3-yl)propan-1-amine | PIB | 1300 | 2.0 | 1.0 | 40% |
| C6 | 2-(10H-phenothiazin-10-yl)ethan-1-amine | PIB | 1300 | 2.0 | 1.0 | 40% |
| C7 | 2-Ethyl-1-hexylamine/E-100 and Ethyleneamine | PIB | 1000 | 1.9 | 1.02 | 90% |
| C8 | Phenothiazine, mono-nonyl phenothiazine, di-nonyl phenothiazine, tri-nonyl phenothiazine | clay | N/A | N/A | N/A | N/A |
| C9 | N/A | HPIP | 40,000 | 0 | N/A | N/A |
| C10 | N-phenyl-p-phenylenediamine | EP | 23,000 | 4.7 | 1.0 | 38% |
| C11 | N-phenyl-p-phenylenediamine | HPIP | 40,000 | 7.9 | 1.0 | 39% |

TABLE 8

Measured Viscosity Values (Pa-s) at Three Shear Rates (1/s) of Each Comparative Example

| C. Ex. | η (Pa-s) at shear rate at 2.1 (1/s) | η (Pa-s) at shear rate at 4.1 (1/s) | η (Pa-s) at shear rate at 8.1 (1/s) |
|---|---|---|---|
| C1 | 20.49 | 14.26 | 9.43 |
| C2 | 20.91 | 14.70 | 8.90 |
| C3 | 14.16 | 9.81 | 5.28 |
| C4 | 9.62 | 4.77 | 2.39 |
| C5 | 8.80 | 4.73 | 2.37 |
| C6 | 19.12 | 12.82 | 7.62 |
| C7 | 11.95 | 6.72 | 3.37 |
| C8 | 21.74 | 14.49 | 9.00 |
| C9 | 25.67 | 16.96 | 10.47 |
| C10 | 10.28 | 7.35 | 3.82 |
| C11 | 3.96 | 2.23 | 1.13 |

At all shear rates, it is apparent that the inventive functionalized polymers in the examples have a lower viscosity than the comparative examples. A lower viscosity is indicative of an improved dispersancy.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby.

The term "comprising" is considered synonymous with the term "including." Likewise, whenever a composition, an element, or a group of elements is preceded with the transitional phrase "comprising", it is understood that we also contemplate the same composition or group of elements with transitional phrases "consisting essentially of", "consisting of", "selected from the group of consisting of", or "is" preceding the recitation of the composition, element, or elements and vice versa.

What is claimed is:

1. A functionalized olefinic polymer comprising an olefinic polymer bound to at least one fused-ring polycyclic amine, wherein the fused-ring polycyclic amine comprises at least one secondary amine and at least one other heteroatom therein and further comprises at least one primary amine directly pendant to an aromatic carbon of the fused-ring polycyclic amine, wherein the at least one fused-ring polycyclic amine is bound to the olefinic polymer through the at least the one primary amine, and wherein the fused-ring polycyclic amine is a tricyclic aromatic amine comprising two aromatic rings bridged by a nitrogen atom as a first bridge, and a second bridge comprising a heteroatom radical selected from the group consisting of —O—, —NH—, —Se—, —SO—, and —$SO_2$—.

2. The functionalized olefinic polymer of claim 1, wherein pendant amine groups comprising an alkyl-linking group or chain between the primary amine and fused-ring polycyclic amine are absent.

3. The functionalized olefinic polymer of claim 1, wherein the fused-ring polycyclic amine comprises a secondary amine bridging group joining at least two aromatic rings and at least one other heteroatom within the ring structure.

4. The functionalized olefinic polymer of claim 1, wherein the fused-ring polycyclic amine comprises aromatic rings selected from the group consisting of benzene, naphthalene, anthracene, phenanthrene, pyrene, and combinations thereof, and phenyl- and alkyl-substituted versions thereof.

5. The functionalized olefinic polymer of claim 1, wherein the fused-ring polycyclic amine can be described with reference to the structure:

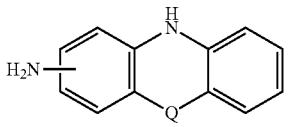

wherein Q is a heteroatom radical selected from the group consisting of —O—, —NH—, —Se—, —SO—, and —$SO_2$—.

6. The functionalized olefinic polymer of claim 1, wherein the fused-ring polycyclic amine is selected from the group consisting of 3-amino-10H-phenoxazine, 3-aminophenoxathiine, 3-aminophenothiazine-5-oxide, 3-aminophenothiazine-5,5-dioxide, and combinations thereof.

7. The functionalized olefinic polymer of claim 1, additionally comprising partially functionalizing the olefinic polymer with ethyleneamine and/or oligomers of ethyleneamine.

8. The functionalized olefinic polymer of claim 1, wherein the olefinic polymer is selected from the group consisting of polyisobutylene; ethylene-propylene copolymer; hydrogenated polyisoprene polymer; and polybutadiene polymer; and copolymers thereof.

9. The functionalized olefinic polymer of claim 1, having a sooted viscosity (in Gp. II base stock, 9.0 wt % carbon black) at a shear rate of 2.1 $s^{-1}$ (±0.1) of less than 12 Pa-s as measured with a Haake RS600 Rheometer controlled by Haake RheoWin Job Manager software.

10. The functionalized olefinic polymer of claim 1, wherein the polymer is partially or fully hydrogenated prior to functionalization.

11. The functionalized olefinic polymer of claim 1, having an Mw/Mn (GPC-PS) within a range from 1 to 4.

12. The functionalized olefinic polymer of claim 1, having an Mn within a range from 500 g/mole to 100,000 g/mol (GPC-PS).

13. The functionalized olefinic polymer of claim 1, having a Functionality Value (Fv), representing the average number of fused-ring polycyclic amines per polymer chain, of 12 or less.

14. The functionalized olefinic polymer of claim 1, wherein the functionalized olefinic polymer is obtained by reacting fully or partially hydrogenated polymer with an acylating agent and thereafter reacting the acylated polymer with the fused-ring polycyclic amine to form the functionalized olefinic polymer.

15. The functionalized olefinic polymer of claim 14, wherein the acylating agent is succinic anhydride.

16. The functionalized olefinic polymer of claim 15, having a Functionality Value (Fv), representing the average number of succinic anhydride groups per polymer chain, of 12 or less.

17. The functionalized olefinic polymer of claim 14, wherein the olefinic polymer has an Mn within a range from 500 g/mole to 100,000 g/mol (GPC-PS).

18. The functionalized olefinic polymer of claim 14, wherein the reaction is a thermal maleation process.

19. The functionalized olefinic polymer of claim 14, wherein the polymer is polyisobutylene.

20. A lubricating oil composition comprising or resulting from the admixing of at least 50 mass % of one or more base stocks, based upon the weight of the lubricating oil composition; and one or more functionalized olefinic polymers of claim 1.

21. The lubricating oil composition of claim 20, further comprising one or more additional additives selected from the group consisting of dispersants; detergents; friction modifiers; antioxidants; pour point depressants; anti-foam agents; viscosity modifiers; inhibitors and/or anti-rust agents; and antiwear agents.

22. A concentrate comprising or resulting from the admixing of from 1 to less than 50 mass % of one or more base stocks; and from 0.10 to 20 mass %, based upon the weight of the concentrate, of one or more of the functionalized olefinic polymers of claim 1, based upon the weight of the concentrate.

* * * * *